US005994633A

United States Patent [19]

Norton

[11] Patent Number: 5,994,633

[45] Date of Patent: Nov. 30, 1999

[54] STRINGED MUSICAL INSTRUMENTS

[76] Inventor: Hugh M. Norton, 20 Peters St., Cambridge, Mass. 02139

[21] Appl. No.: 09/237,383

[22] Filed: Jan. 26, 1999

[51] Int. Cl.[6] ..... G10D 3/00

[52] U.S. Cl. ..... 84/290; 84/291; 84/293; 84/723

[58] Field of Search ..... 84/723–724, 725–727, 84/275, 290–293, 298–299, 307–309

[56] References Cited

U.S. PATENT DOCUMENTS

| | | | |
|---|---|---|---|
| 2,460,943 | 2/1949 | Nelson | 84/293 |
| 3,396,621 | 8/1968 | Dycus | 84/293 |
| 3,443,018 | 5/1969 | Krebs | 84/1.16 |
| 3,538,807 | 11/1970 | Francis | 84/267 |
| 4,200,023 | 4/1980 | Kaman | 84/293 |
| 4,254,683 | 3/1981 | Nulman | 84/1.16 |
| 4,295,403 | 10/1981 | Harris | 84/293 |
| 5,052,269 | 10/1991 | Young, Jr. | 84/728 |
| 5,315,910 | 5/1994 | Soupios | 84/453 |
| 5,347,904 | 9/1994 | Lawrence | 84/291 |
| 5,353,672 | 10/1994 | Stewart | 84/291 |
| 5,398,581 | 3/1995 | Castillo | 84/291 |
| 5,637,823 | 6/1997 | Dodge | 84/743 |
| 5,756,914 | 5/1998 | Streibl | 84/465 |

*Primary Examiner*—Robert E. Nappi
*Assistant Examiner*—Marlon Fletcher
*Attorney, Agent, or Firm*—Edward W. Porter

[57] ABSTRACT

A stringed musical instrument, such as a guitar, mandolin, or a violin, has an elongated frame to which modular components such as necks, electronic pick-ups, electronic control boxes, bridges, tail pieces, decorative components, or body parts can be adjustably placed and clamped. This not only allows the position of many such components to be customized, but also allows different components to be easily substituted for each others; allows the instrument to be quickly taken apart for more compact storage or shipment; and allows the instrument to be changed so as to produce a different sound or look. Preferably some the components, including the body parts, are rotatably mounted relative to the frame, so their angle relative to the plane of the fingerboard can be adjusted to suit a user's tastes or physical disabilities, such as carpel-tunnel stress syndrome. In some embodiments, an entire string assembly, comprised of a set of strings connected between a head and a bridge or tail piece, can be modularly attached to or replaced from the instrument.

26 Claims, 15 Drawing Sheets

119B
302
117
128

119C
302A
117A
128A 100B
290
116B
160A
190

119B
100C
116B
128
190
190

119C
100D
116B
128A
190

STRINGED MUSICAL INSTRUMENTS

FIELD OF THE INVENTION

The present invention relates to stringed musical instruments, including, without limitation, guitars, mandolins, bass guitars, banjos, bass fiddles, and violins.

BACKGROUND OF THE INVENTION

Stringed musical instruments, such as guitars, mandolins, bass guitars and violins, have been used for many years. Their sounds have brought most humans many hours of enjoyment and they are among the most important of all musical instruments. Although many prior-art stringed musical instruments work very well, there are, however, certain features which they lack.

For example, some people would find it desirable to make it easier to customize the look, feel, properties, and performance of a stringed instrument to suit an individual user's long term preference or his current desires. Normally with prior art stringed instruments it is difficult or virtually impossible to change most aspects of the instrument once it has been purchased.

In certain cases it would be desirable to be able to more compactly carry and ship a stringed instrument. This is particularly true for a player who would like to take with him the equipment necessary to provide different musical qualities, such as the different qualities of a twelve-string and a six-string guitar, or different tonal qualities, such as mellow, bright, loud, and brassy tonal qualities.

For some players the angle of the fingerboard of the neck along its major axis relative to the player's body and hands is awkward. This can be particularly true for players with certain physical handicaps, such as carpal-tunnel stress syndrome.

Finally, many musicians, particularly rock musician, desire to have guitars which have a look which is different from that of traditional stringed instruments, and they may often desire to change that look at different times.

SUMMARY OF THE INVENTION

It is an object of the present invention to provide a stringed musical instrument which is easier to customize than most current such instruments.

It is another object of the present invention to provide a stringed musical instrument which has a distinctive appearance.

It is yet another object of the present invention to provide a stringed musical instrument which is easy to adjust.

It is still another object of the present invention to provide a stringed musical instrument which can be made easier to play for players with certain physical handicaps.

It is yet another object of the invention to reduce the space required to transport one or more stringed musical instruments.

It is still a further object of the invention to reduce the space and weight required to carry the equipment necessary to provide a variety of musical characteristics.

The present invention relates to stringed musical instrument, including, without exclusion, a guitar, a mandolin, a bass guitar, a banjo, a bass fiddle, a cello, or a violin.

According to one aspect of the invention, a stringed instrument is provided which has a neck extending along a longitudinal axis between the neck's top and bottom ends.

The neck includes a head near the neck's top end for holding and terminating the vibration of one end of a length of each of a set of musical strings. The neck also includes a fingerboard extending between the head and the neck's bottom end. The instrument also includes an elongated frame which extends along a longitudinal axis. This frame includes a frame-to-neck mounting for attachment to the neck so the frame extends out from the bottom end of the neck and so the longitudinal axis of the neck and the frame are roughly parallel. The instrument further includes at least two adjustably positionable components each including a component-to-frame mounting for adjustably fixedly attaching the component to the frame at any one of a number of positions along the frame's longitudinal axis. One of these adjustably positionable components is a bridge component having a bridge for terminating the vibration of the other end of each of the instrument's lengths of string. Another of these adjustably positionable components is a pick-up component including electronic circuitry for deriving an electronic signal from the vibrations of the strings.

In some embodiments of this aspect of the invention another adjustably positionable component is a body-part component. In some such embodiments, the body part's componen-to-frame mounting is a rotatable mounting which allows the body part to rotate about an axis generally parallel to the longitudinal axis of the frame.

In some embodiments of this aspect of the invention, the component-to-frame mountings of the adjustably positionable components include clamps, which can be loosened to allow the component to slide along the longitudinal axis of the frame and can be tightened to allow the component to be fixed to the frame at a desired position. In embodiments in which the elongated frame includes two parallel cylindrical rods each extending in a direction parallel to the frame's longitudinal axis, the clamps can be loosened to allow the component to slide along the rods and can be tightened to allow the component to be clamped fixed to the rods at a desired position. In such embodiments, the clamps used for body parts can be designed to extend around only one of the frame's two rods, so when loosened such clamps allow the body part to rotate about the axis of the rod to which it is clamped, and when tightened allow the angle of the body part to be fixed relative to the frame. Frames comprised of parallel rods can further include a torsion bar having a major axis extending parallel to such rods for the purpose of stiffening the frame.

In some embodiments the bridge component includes a mounting structure for enabling a piece of a selected material to be selectively fixed and removed from between the bridge and the component-to-frame clamp, so as to allow the vibrational characteristics of the mounting between the bridge and the frame to be selectively changed.

In some embodiments one of the adjustably positionable components includes an electronic control box, containing electronic controls which can be manipulated by one playing the guitar to alter the electronic signal generated by the pick-up's electronic circuitry.

In some embodiments one of the adjustably positionable components includes decorative components which, in addition to possibly stiffening the frame or changing the balance, serve no purpose other than to change the appearance of the instrument.

In some embodiments, a clamping structure is adjustably attached to the frame to fixedly attach the instrument to another similar stringed instrument by also clamping to the frame of the other similar instrument.

According to another aspect of the invention, a stringed instrument is provided having a neck which extends along a longitudinal axis between the neck's top and bottom ends. This neck includes a head near the neck's top end for holding and terminating the vibration of one end of a length of each of a set of musical strings. The neck also includes a fingerboard extending between the head and the neck's bottom end. The neck further includes a neck-to-frame mounting located near the neck's bottom end. In addition to the neck, the instrument also includes an elongated frame which extends along a longitudinal axis. The frame includes a frame-to-neck mounting for attachment to the neck's neck-to-frame mounting so the frame, when attached to the neck, extends out from the bottom end of the neck with its longitudinal axis extending roughly parallel to that of the neck. The instrument includes one or more adjustably positionable components each including a component-to-frame mounting for adjustably fixable attachment to the frame at any one of a number of positions along the frame's longitudinal axis. One of these components is a bridge component having a bridge for terminating the vibration of the other end of each of the lengths of the instrument's string.

In many embodiments, another of the adjustably positionable components is an electronic pick-up component, and the frame-to-neck mounting is designed to fit with the neck-to-frame mounting of any one of a number of necks which have similar neck-to-frame mountings.

In many embodiments, the neck-to-frame and frame-to-neck mountings include, between them, a device for enabling the angle between the neck and the frame to be varied. For example, a screw can be tightened and loosened to pull together, or push apart, respectively, by variable distances, portions of the neck-to-frame and frame-to-neck mountings.

According to another aspect of the invention a stringed instrument is provided which has a neck that extends along a longitudinal axis between the neck's top and bottom ends. The neck includes a head near the neck's top end for holding and terminating the vibration of one end of a length of each of a set of musical strings. The neck also includes a fingerboard extending between the head and the neck's bottom end. The instrument further includes an elongated frame which extends along a longitudinal axis. The frame includes two cylindrical rods each extending in a direction parallel to the frame's longitudinal axis. The frame also includes a frame-to-neck mounting for attaching the frame to the neck so the frame extends out from the bottom end of the neck with its longitudinal axis roughly parallel to that of the neck. The instrument has one or more adjustably positionable components each including a component-to-frame mounting for adjustably fixable attachment to the frame at any one of a number of positions along the frame's longitudinal axis. Each of these component-to-frame mountings includes a clamp, which can be loosened to allow the component to slide along the rods and which can be tightened to allow the component to be fixed to the rods at a desired position. These components include a bridge, an electronic pick-up, and two or more body parts. Each of the body-part components includes a clamp which extends around only one of the frame's two rods, and which can be loosened to allow the body part to rotate about the rod to which it is clamped, and which can be tightened to fix it at a given rotational angle relative to the frame.

According to another aspect of the invention a stringed instrument is provided which includes a string-mounting structure extending along a longitudinal axis between top and bottom ends. This string-mounting structure need not have the modular frame and component construction described in the previous paragraphs. At its top end the string-mounting structure includes a structure for terminating the vibration of, and holding one end of, each of a set of lengths of musical string. At its bottom end, the string-mounting structure includes a structure for terminating the vibration of, and holding, a second end of each of the set of lengths of musical string. This bottom-end structure includes a bridge. The string supporting structure has a neck extending from its top end toward its bottom end. The neck including a fingerboard which roughly lies within a plane substantially parallel to said longitudinal axis. In addition to the string-mounting structure, the instrument further includes a body structure including a rotatable mounting which mounts the body structure to the string-mounting structure so the body structure can be rotated relative to the string-mounting structure. In many embodiments this rotation is about an axis substantially parallel to the longitudinal axis of the string-mounting structure.

In some embodiments of this aspect of the invention, the rotatably mounted body structure is sized, and it and its mounting are positioned, to support the strumming arm of a person playing the stringed instrument. In some embodiments, the body structure is sized and positioned to support the stringed instrument against the body of a person playing the instrument, so rotating the body structure relative to the string-mounting structure can vary the angle of the plane of the fingerboard relative to the body of the player.

In many embodiments there are at least two body structures, each including a rotatable mounting which enables it to be separately rotated about an axis substantially parallel to the longitudinal axis of the string-mounting structure. These two body structures are mounted so they can be rotated to extend out from the string supporting structure in opposite directions which are generally perpendicular to the longitudinal axis of the string supporting structure and which are generally parallel to the plane of the fingerboard. In many embodiments of the invention, structure is provided for enabling a user of the guitar to selectively vary resistance to rotation of the body structure, so to enable the user to selectively substantially fix such rotation at a desired position.

In some embodiments the instrument is an electric stringed instrument which further includes electronic pick-up circuitry for deriving an electronic signal from the vibrations of the strings; an electronic control box, containing electronic controls which can be manipulated by one playing the guitar to alter the electronic signal generated by the pick-up circuitry; and a rotatable mounting which mounts the control box to rotate about an axis generally parallel with the longitudinal axis of the string supporting structure separately from the rotation of the instrument's body structure.

According to another aspect of the invention a stringed instrument is provided which includes an elongated structure extending along a longitudinal axis between top and bottom ends, including a neck extending from the top end toward the bottom end. The neck includes a fingerboard which roughly lies within a plane substantially parallel to the long structure's longitudinal axis. The instrument also includes a head at the top end for holding one end of each of a set of musical strings and a tailpiece at the bottom end for holding a second end of each of the set of musical strings. The instrument includes a head-release mounting at the top end of the elongated structure for enabling a user to selectively fix the head to, or release the head from, the top end of the elongated structure. It similarly includes a tailpiece-release mounting at the bottom end of the elongated structure for enabling a user to selectively fix the tailpiece to, or release the tailpiece from, the bottom end of the elongated structure. In some embodiments, the tailpiece structure includes a bridge.

The operation of the head- and tailpiece-release mountings enable a user to replace one combination of a head, a tailpiece, and a set of strings held between them with another such combination by releasing the first such combination from the head and tailpiece-release mountings and then fixing the second such combination to the head- and tailpiece-release mountings.

DESCRIPTION OF THE DRAWINGS

These and other aspects of the present invention will become more evident upon reading the following description of the preferred embodiment in conjunction with the accompanying drawings, in which.

DETAILED DESCRIPTION OF PREFERRED EMBODIMENTS

Figure 1:
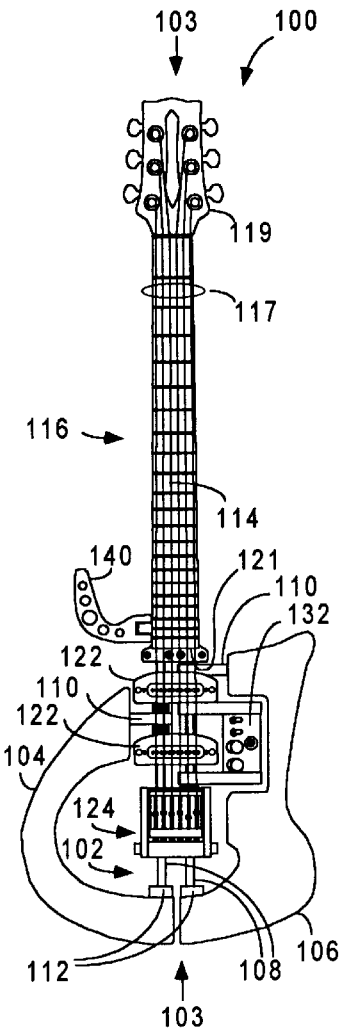
FIG. 1 is a top view of one embodiment of the present invention, which is a guitar which has modular components mounted on an elongated frame, including two body components which protrude from either side of the guitar in FIG. 1.
Figure 2:
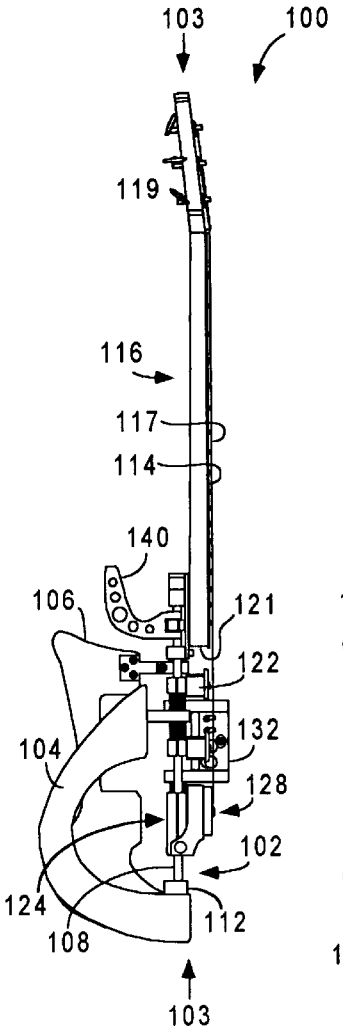
FIG. 2 is a side view of the guitar of FIG. 1, with its two body components rotated ninety degrees below the plane of the paper in FIG. 1.
Figure 3:
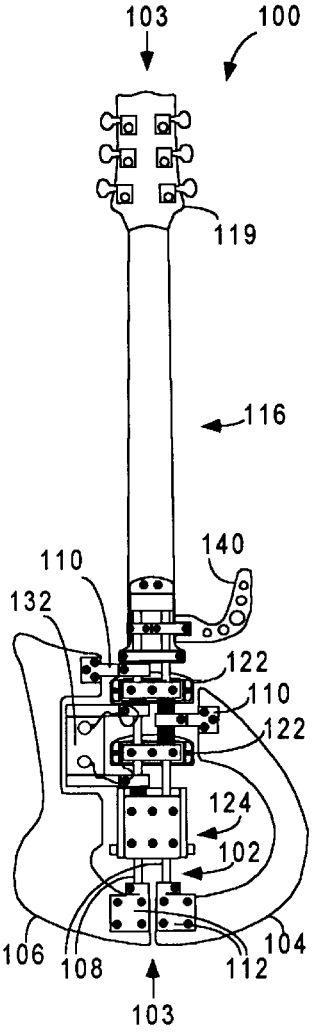
FIG. 3 is a bottom view of the guitar of FIG. 1, with its two body components in the same position as in FIG. 1.
Figure 4:
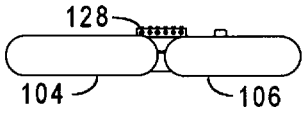
FIGS. 4–7 are bottom end views of the guitar of FIGS. 1–3, showing different rotational angles of its body components and it frame.

FIGS. 1–10 are views of a guitar 100, which is one embodiment of the present invention. The guitar 100 uses a modular frame-and-component structure. It has modular components mounted on an elongated frame 102, which has a longitudinal axis parallel to the axis indicated by the line between the arrows 103 shown in FIGS. 1–3. These modular components include two rotatable body components 104 and 106 which can protrude on either side of the guitar as is shown in FIGS. 1 and 4. The modular frame includes two parallel stainless steel rods 108 which extend in a direction parallel to the longitudinal axis 103.

The guitar has a neck 116 which is mounted to the frame 102, so the longitudinal axis of the neck will be generally parallel to the same axis as the frame, that defined by the arrows 103 in FIGS. 1–3. The neck extends between a head 119 and a bottom 121. A set of strings 117 is mounted between the guitar's head 119 and its bridge assembly 124. In the guitar 100 the head and bridge both terminate the vibration of, and hold, one end of each of the set of strings 117.

The body-part components 104 and 106 are each mounted to rotate about one of the rods with a clamp 110 and 112. As is shown in FIGS. 4–7, this rotation allows the angular position of the body parts 104 and 106 to be varied. If the body parts are left in the position shown in FIGS. 1, 3, and 4, the body parts and the fingerboard 114 of the guitar's neck 116 will be in substantially parallel planes.

Figure 5:
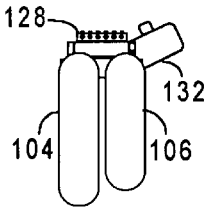

If the body parts are both rotated down ninety degrees below the plane defined by the frame's two rods 108, the guitar will have the appearance shown in FIGS. 2 and 5. This position can be used to allow the user to have easier access to other components of the guitar when reconfiguring it. If the body parts are each rotated below the frame by less than ninety degrees, an arrangement such as that shown in FIG. 6 can be produced. This will hold the strings further out from the body of a person playing the guitar. If the upper body part 104 is rotated below the plane defined by the frame's two rods (which is substantially parallel to the plane of the fingerboard) and the lower body part 106 is rotated above that plane, the plane of the fingerboard will be tilted downwards, so that a player will not have to bend his or her hand at the wrist as much to press his fingers against the fingerboard. This tilt can greatly reduce the stress on the player's hand. Such reduction in stress can be particularly important if the player suffers from carpal-tunnel stress syndrome or any other inability which makes it hard or painful to bend the hand at the wrist for a prolonged period. The invention enables the tilt of the fingerboard to be varied frequently during play, which can also be used to reduce physical stress.

As will be discussed below in greater details, the clamps 110 and 112 which hold the body-part components to the frame can be tightened to various degrees, so that the body parts rotate freely, so that they rotate only with the application of considerable force, or so that they are rigidly fixed in place.

The guitar 100 shown in FIGS. 1–10 is made of modular components. In fact, it is made of the subset of the modular components shown within the dotted lines 125 in FIG. 11.

The modular components of the guitar 100 include the frame 102 and the neck 116, discussed above. The frame is attached to the neck 116 by screws which can be placed through the screw holes 118 in the mounting plate 120 shown in FIG. 11.

The guitar 100 also includes a plurality of components which are designed to slide on, or clamp on, and which, when tightened, clamp tightly onto one or both of the frame's parallel rods 108. This includes the two body parts 104 and 106 each of which is designed to clamp onto one of the frames two rods 108, as discussed above. It also includes two electronic pick-ups 122, each of which includes circuitry for deriving an electronic signal from the vibration of strings above such pick-ups.

Figure 11:
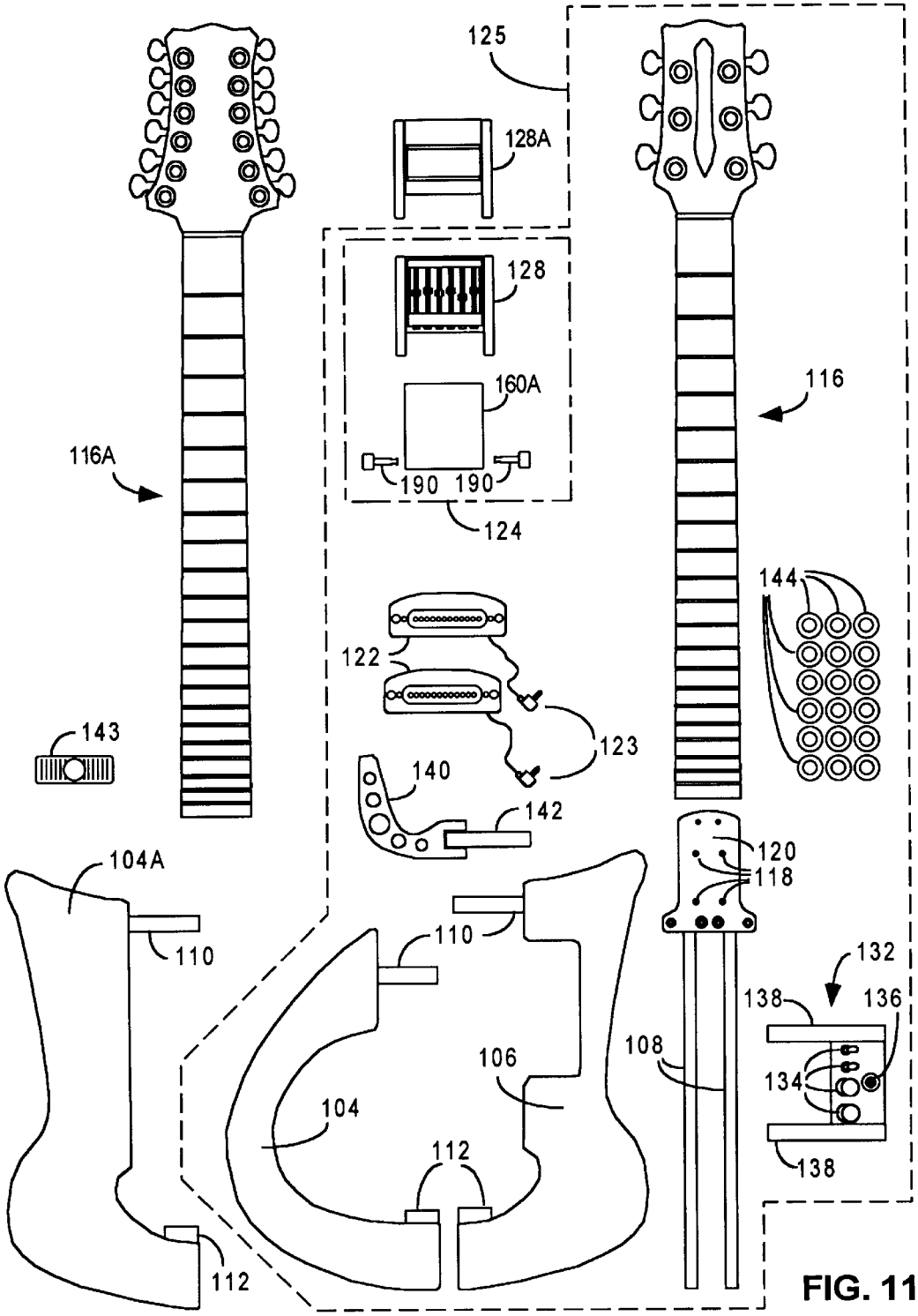
FIG. 11 is a top view of the modular components of the guitar shown in FIGS. 1–10, including in addition some of the many other components which can be substituted for, or used in addition to, such components.

The subset's clampable components also include a bridge assembly 124 shown in FIG. 11. This includes a bridge assembly clamp 160A for sliding and clamping onto the frame's two rods, and a bridge module 128 which can be attached to the bridge assembly clamp through pins 190, as will be described below in greater detail. The bridge module includes a bridge/tailpiece for both terminating the vibration of and holding one end of each of the guitar's strings. In other embodiments of the invention a separate bridge component and tail-piece component could be used to perform these two functions, respectively.

Figure 10:
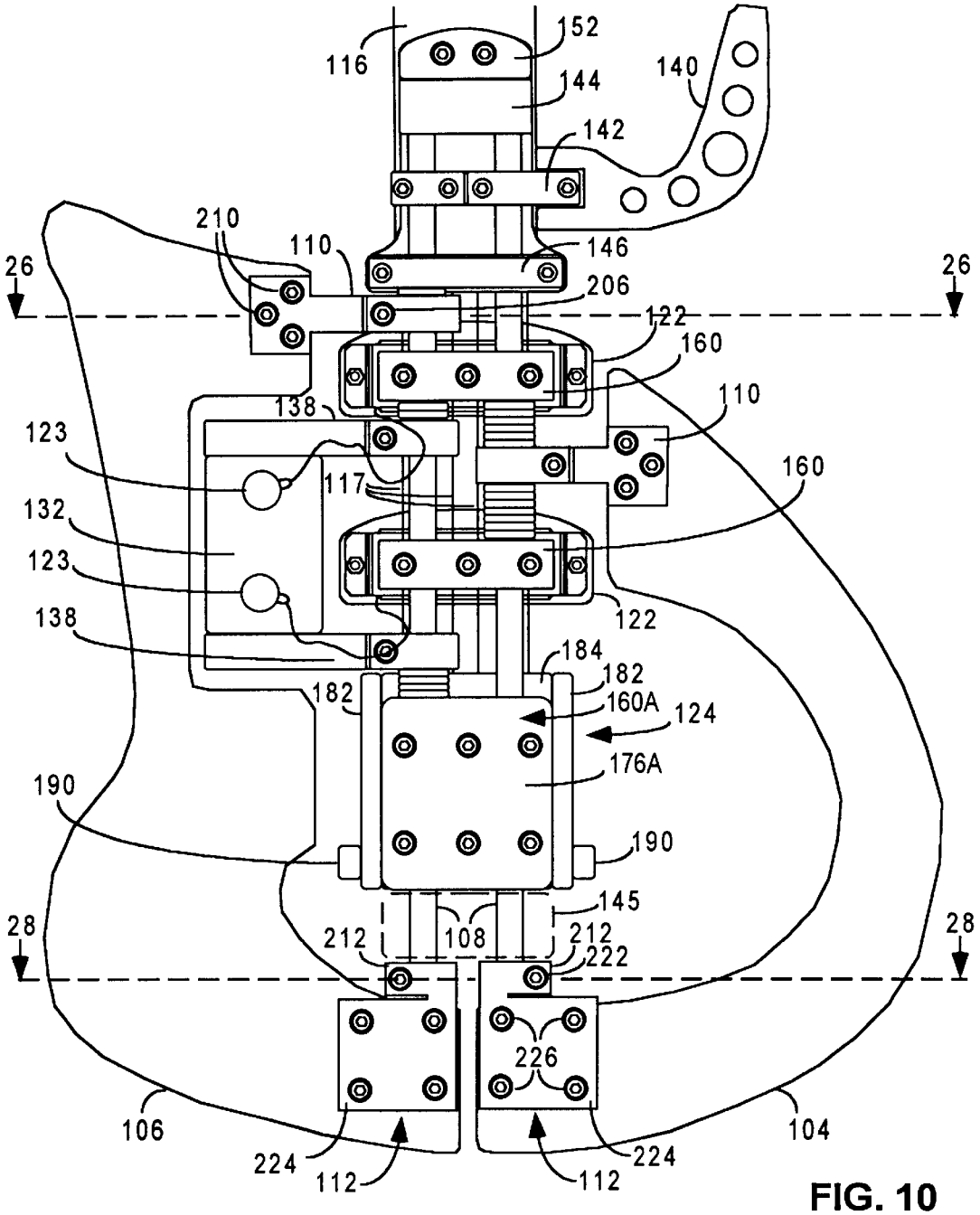

The guitar 100 also includes a control box 132, which includes controls 134 for allowing a player of the guitar to vary the electronic signal output by the guitar. This control box receives electronic inputs from the jacks 123 which extend out from pick-ups 122. These jacks connect to the underside of the control box, as is shown in FIG. 10. The output of the control box is delivered to a jack socket 136 shown in FIG. 11.

Figure 6:
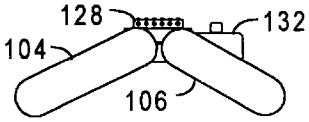
Figure 7:
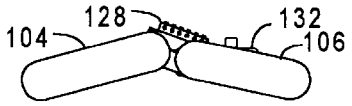
Figure 9:
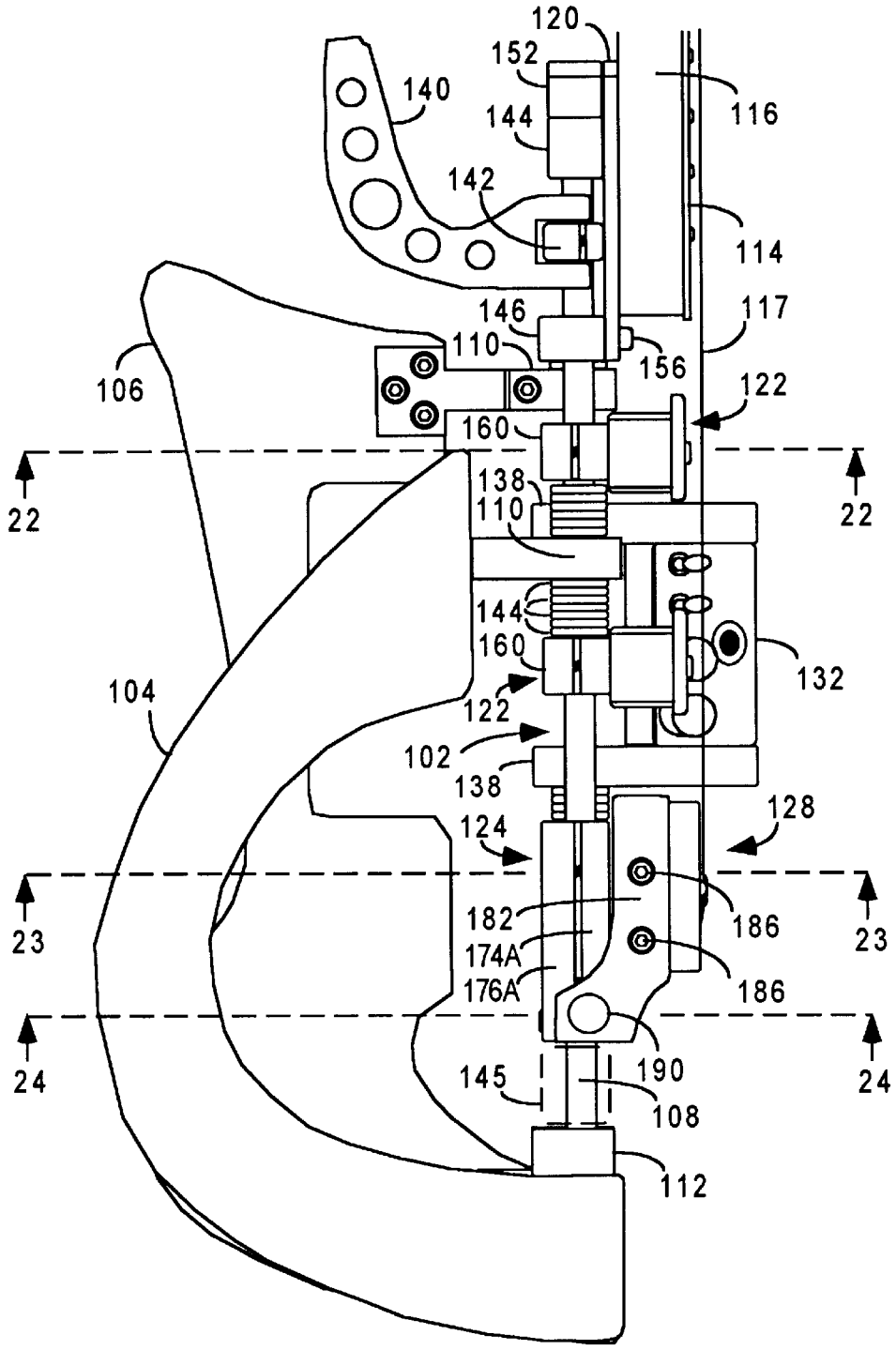

The control box can be rotatably connected to one of the frame rods 108 by clamps 138, which can best be seen in FIG. 10. The fact that the control box is mounted to rotate relative to the frame separately from the body parts means that its angle relative to the frame can be different from its nearest body portion, as is indicated in FIG. 9. This independent rotation of the control box allows the player to use the body parts to provide the strings and fingerboard with the desired position and angle relative to the body, while placing the control box at a separate angle which allows easiest access to its controls while playing. This is shown in FIG. 6, in which the control box is shown protruding out at a separate angle from the frame than is its nearest body part 106. In alternate embodiments of the invention, the control box can be rotatably mounted to one of the body portions to achieve a similar effect.

The guitar 100 also includes a strap attachment 140, shown in FIGS. 1–3 and 10, which is rotatably attached to a clamp 142 which can be clamped onto the two rods of the frame 102 under the mounting plate 120.

Figure 18:
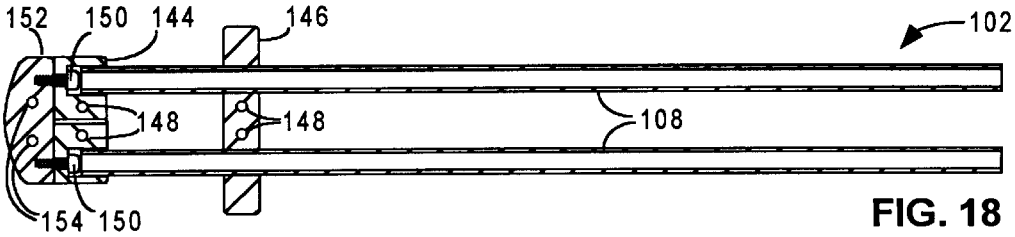
FIG. 18 is a cross sectional view of the frame of FIGS. 12 and 13 taken along the lines 18—18 shown in FIG. 19.

Finally, the guitar 100 includes eighteen spacers 114 which can be used to hold various of the body part clamps in place when their clamps 110 and 112 have been loosened, as shown in FIGS. 18–10. In the guitar 100 these spacers are shown as being shaped like simple washers, as can be seen in FIG. 11. Such spacers are simple, but they have the disadvantage of requiring that they be completely slid off the end of a rod 108 to be removed from it. This requires that all other clamps be removed from between the spacer and the end of the frame. In other embodiments, clamp-like spacers are used, which can be opened and closed around a frame rod, in a manner similar to the clamps shown in FIG. 26, rather than requiring that they be slid all the way off the bottom of the frame. It is possible to construct and use the guitar 100 without any such spacers. To prevent body-part clamps 112 from falling off the rods, one can merely keep the body-part clamps 110 and 112 tight enough to prevent such sliding.

FIG. 11 also illustrates some of the many other modular components which can be used in exchanged for, or in addition to, the components within the dotted lines 119, described above. This include a twelve-string guitar neck 116A which can be used in place of the six-string neck 116 shown in FIGS. 1–11. When one uses the twelve-string neck, a twelve-string bridge module 128A should be used to replace the six-string bridge module 128 discussed above. The ability to replace the six-string neck and bridge module with the twelve-string neck and bridge module allows one to have the capacity to alternate between playing a six- and twelve-string guitar without the need to carry two complete guitars. The fact that the guitar can by broken into components means that it can be shipped much more compactly. Once one learns how to assemble a guitar from such components, it can be done completely, with everything except tuning, in approximately 12 minutes.

FIG. 11 also shows an upper-body component 104A which can be used in place of the upper body component 104 to give the guitar a more symmetrical appearance. The figure also includes a decorative clamping block 143, designed to be clamped onto the frame at the position 145 shown with dotted lines in FIGS. 8–10. This block has no function other than altering the appearance of the guitar and, perhaps, stiffening its frame and/or changing its balance. The block is designed to clamp to the frame like either of the component-to-frame clamp 160A or 160B shown in FIGS. 23 and 25, respectively.

It is intended that many other components not shown in FIG. 11 can also be used with a given frame. Such additional components include, among others things, different types of electronic pick-ups, bridges, body parts, necks, and decorative components. This variety of components enables one to have wide latitude in varying the sound, feel, look, and performance of a given guitar.

The instrument's modular construction also allows various parts to be made by different manufacturers from all over the world, and then to be assembled rapidly by relatively unskilled labor. It also enables custom guitars to be quickly and easily manufactured to order from an inventory of components, in response to mail or Internet orders, the way that personal computer are commonly manufactured to order for individual consumers by putting together specified components.

The invention's modular construction also enables stringed musical instruments to be shipped and sold in unassembled kit form, which not only reduces shipping costs, but also reduces the cost at which such instruments can be profitably sold. The invention's modular construction also makes it easy for one to buy a less expensive version of an instrument and then to upgrade it by replacing or adding modular components.

Many guitar companies feature signature models developed in collaboration with famous musicians. The modular construction of the guitar shown in FIGS. 1–11 allows artists of all types to design their own guitars, by selecting from a wide variety of possible shapes and materials, making it easier for them to provide greater individuality for their signature version of an instrument.

Since the body is not a structural member in the type of guitar shown in FIGS. 1–11, almost any object of appropriate weight, size, and structural characteristics can be used as a "body" on such a guitar. To cite just a few examples, distinctive body-part components could be made from pictures or keepsakes encased in acrylic, animal horns or bones, stuffed and protectively-coated animal bodies, dulled knife blades, road signs, computer keyboards, or even neon lights. All of these distinctive body-parts could be made to clamp on to a single type of frame, greatly increasing the ease of making guitars with a distinctive appearance, and greatly increasing the ease and speed of radically changing the appearance of any one given guitar.

Figure 12:
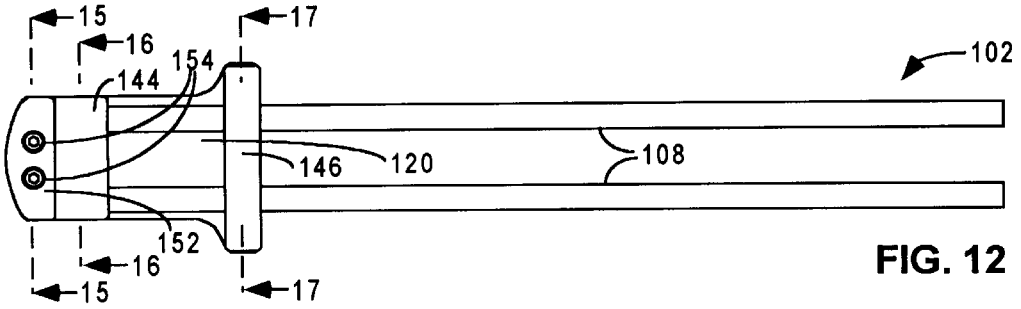
FIGS. 12 and 13 show bottom and top views of the frame used in the guitar of FIGS. 1–10.
Figure 13:
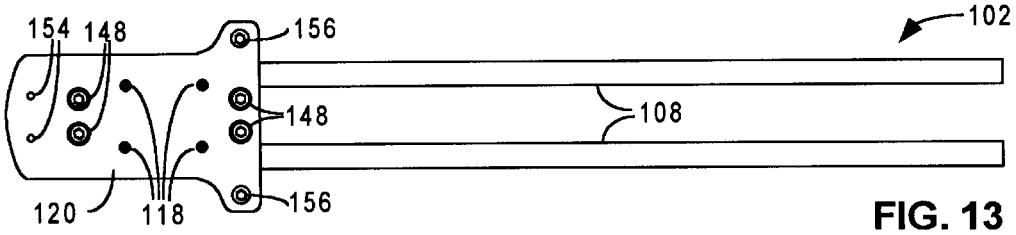
Figure 14:
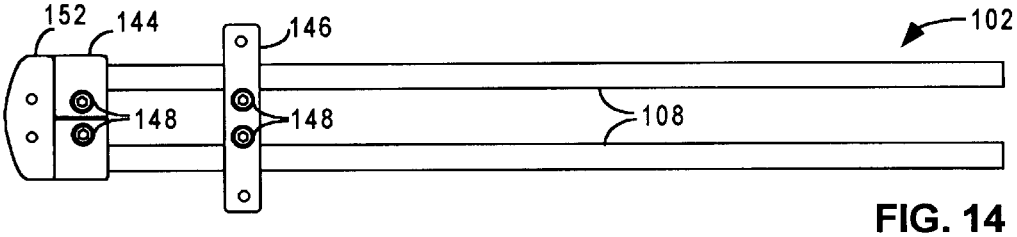
FIG. 14 is a top view similar to that in FIG. 13, except that in FIG. 14 the plate shown in FIG. 13 is removed.
Figure 19:
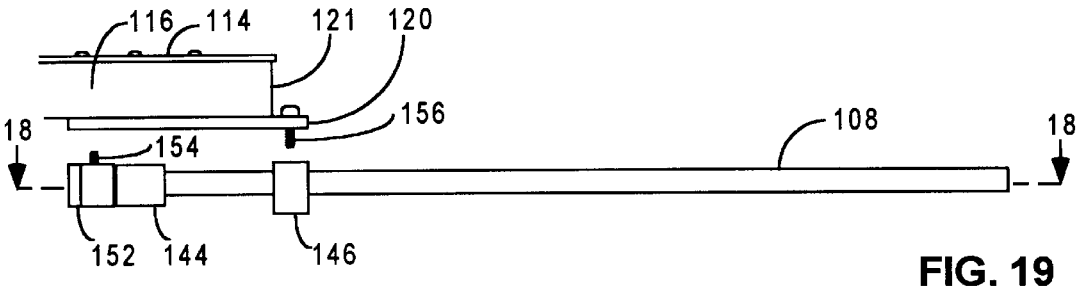
FIGS. 19 and 20 show how the plate which is shown in FIG. 13 and missing in FIG. 14 can be used as a neck-to-frame mounting located on a neck which is designed to mate with the frame-to-neck mounting formed by the top of the frame shown in FIG. 14.
Figure 20:
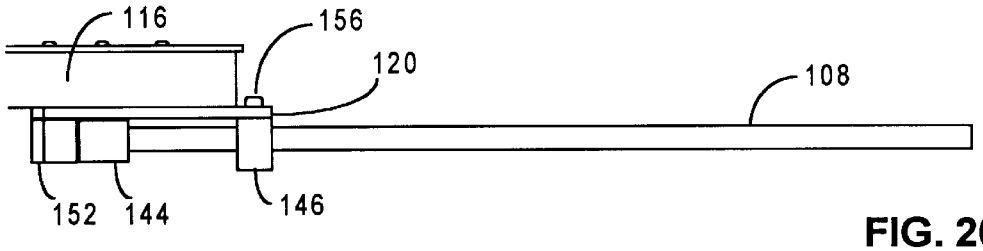

FIGS. 12, 13, and 20 are bottom, top, and side views, respectively, of the frame 102 with the mounting plate 120 attached. FIGS. 14 and 19 are top and side view of the frame with the mounting plate removed. In FIGS. 19 and 20 a neck 116 is shown attached to the mounting plate.

Figure 16:
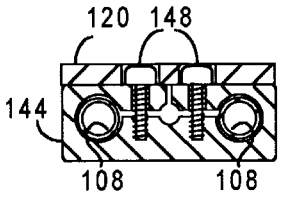
Figure 17:
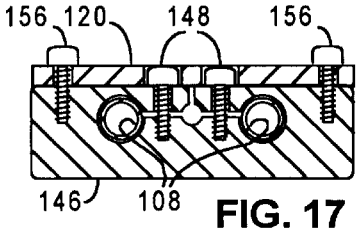

As can be seen from these figures the frame includes not only the two cylindrical rods 108, but also rear and front frame clamps 144 and 146 shown in FIGS. 12, 14, 19 and 20. FIGS. 16 and 17, respectively, show cross sections of the rear and front frame clamps 144 and 146 taken along the lines 16—16 and 17—17 in FIG. 12. As can be seen in these cross sections, each of these clamps has screws 148 which can be accessed through holes in the mounting plate to tighten around each of the cylindrical rods 108. This arrangement allows these two clamps to firmly hold the two rods 108 in place.

As can be seen in FIG. 18, which is a cross section of the frame taken along the lines 18—18 in FIG. 19, the rear frame clamp 144 has two screws 150 which attach it to the rear piece 152 of the frame. FIG. 18 also shows that in the guitar 100 the rods 108 are hollow tubes, so as to reduce the weight of the frame. In some embodiments the guitar's wiring can be passed through such hollow tubes to provide electrical shielding for the purpose of preventing unwanted signals from being induced into the guitar's electronic output.

Figure 15:
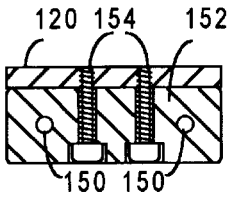
FIGS. 15, 16, and 17 are cross-sectional views of the frame shown in FIG. 12, taken, respectively, along the lines 15—15, 16—16, and 17—17 shown in FIG. 12.

As can best be seen from FIG. 15, which is a cross section of this rear piece taken along the lines 15—15 in FIG. 12, two screws 154 can be used to hold the rear piece 152 to the mounting plate 120. Similarly, two screws 156 can be used to hold the mounting plate 120 to the front frame clamp 146, as shown in FIG. 17.

The mounting plate 120 can be used differently. A user may have a plurality of necks, such as the two necks shown in FIG. 11, and selectively screw a single mounting plate 120 to the individual neck which he or she wants to use at a given time with screws (not shown) which would pass through the four holes 118 shown in FIG. 13. A quicker and more preferable way to use the invention would be to have a separate mounting plate 120 mounted to each of the plurality of guitar necks which might be used with the frame, which would then allow the user to quickly attach the frame to the mounting plate 120 by use of the screws 154 and 156, as is indicated by the combination of FIGS. 19 and 20. In this case the mounting plate would act as a neck-to-frame mounting and the rear piece 152 and front frame clamp 146 would act as a frame-to-neck mounting.

Figure 21:
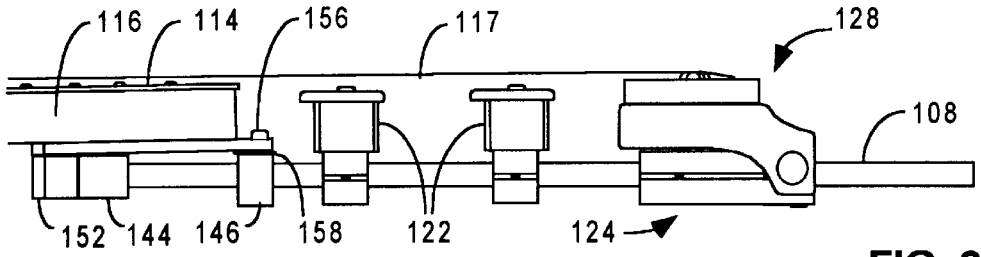
FIG. 21 shows how the angle between the neck and the frame can be altered by use of screws and a shim.

FIG. 21 shows that the angle between the neck and the frame can be varied slightly by loosening the screws 156; by placing a shim 158 of a desired thickness between the mounting plate 120 and the front frame clamp 146; and by then re-tightening the screws to securely hold the mounting plate and shim in place. This method can be used to adjust the angle between the fingerboard 114 of the guitar and its strings 117.

Figure 8:
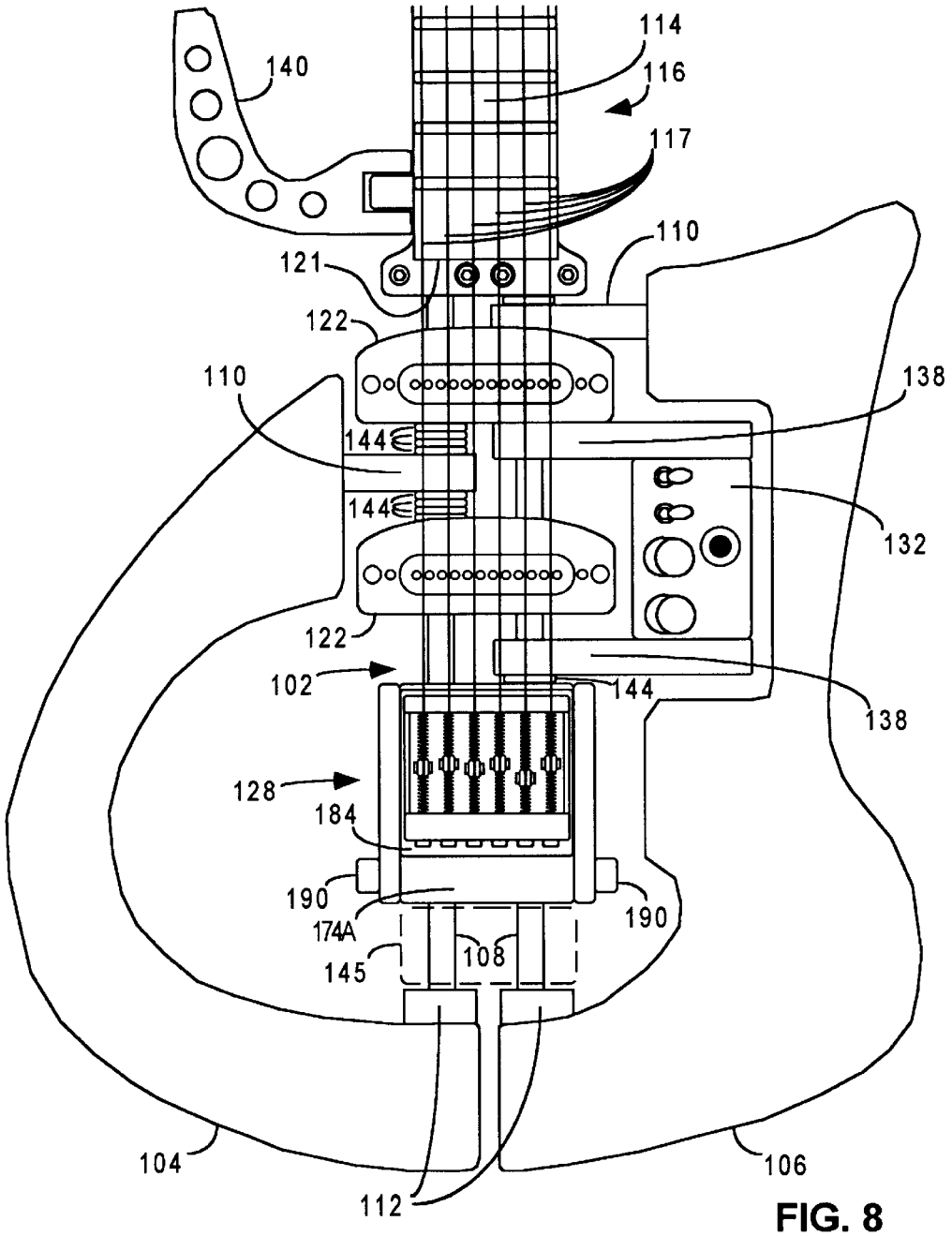
FIGS. 8, 9, and 10 are enlarged views of roughly the bottom half of the views shown in FIGS. 1, 2, and 3, respectively.

As is shown in FIG. 21, as well as in FIGS. 8–10, the pick-up components 122 and bridge assembly components 124 can be slid onto and/or fixed in place at a desired location on the rods 108 of the frame, using the component-to-frame clamps 160 shown in FIGS. 22–25.

Figure 22:
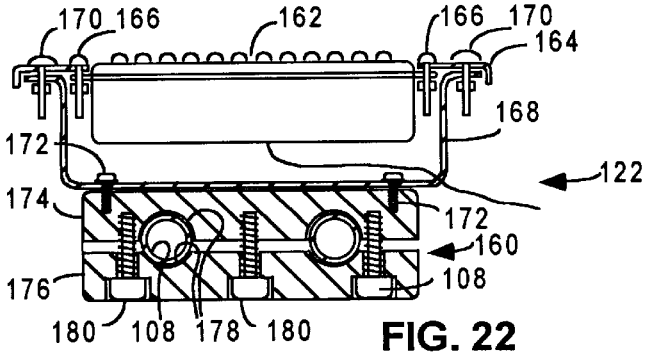
FIG. 22 is a cross-sectional view of the pick-up component shown in FIGS. 1–3 and 8–10, taken along the line 22—22 in FIG. 9.

FIG. 22 is a cross section of a pick-up component 122 taken along the lines 22—22 in FIG. 9. It includes an electronic pick-up module 162, which is not shown in cross section for purposes of simplification. This electronic pick-up can be an acoustic, and electromagnetic, or optical pick-up, or any other type of pick-up capable of producing an electronic signal to reflect the vibrations of musical strings placed in close proximity to it. As used in this specification and the claims that follow, the phrase "electronic pick-up" is not limited to just "active" pick-ups which use external electric power to help produce their output signal, but also to any other pick-up which generates an electronic output representing the vibration of an instrument's musical strings. The pick-up module is attached to a top metal plate 164 with screws 166. This top plate is, in turn, attached with screws 170 to tabs on a pan 168 made of stamped metal. The pan 168 is screwed onto a component-to-frame clamp 160 with screws 172.

The component-to-frame clamp 160 is made from two aluminum blocks, a top block 174 and a bottom block 176, both of which have had partially cylindrical grooves 178 milled in them so the surfaces of each such groove can fit against the curved surface of one of the frame's two cylindrical rods 108, as shown in FIG. 22. Both the top and bottom blocks of the clamp have been threaded to receive three screws 180. As can be seen from FIG. 22, the screw holes in the bottom block are counter-sunk so the heads of the screws will not protrude when the clamp is tightened, to reduce the tendency of the bottom of the clamps to catch on skin or clothing or to scratch other surfaces.

The screws 180 can be used to tighten the two blocks together so as to tightly clamp the frame rods 108 in the groves 178; to loosen the two blocks so the clamp can slide along the length of the rods 108; or to allow the two blocks of the clamp to be completely separated so the clamp and its associated pick-up component can be lifted off the rods without requiring being slid off the end of the rods. This final option allows the clamp and its associated component to be removed from the frame without requiring other components clamped between it and the end of the rods to be removed first.

The ability to adjust the position of the pick-ups along the frame rods 108 allows the quality of sound derived by the pick-ups to be varied, since the amplitude ratio of low-frequency to high-frequency harmonics varies as a function of distance from the center of the string's vibration.

FIGS. 8, 9, and 10, respectively, provide top, side, and bottom views of the pick-up components 122.

Figure 23:
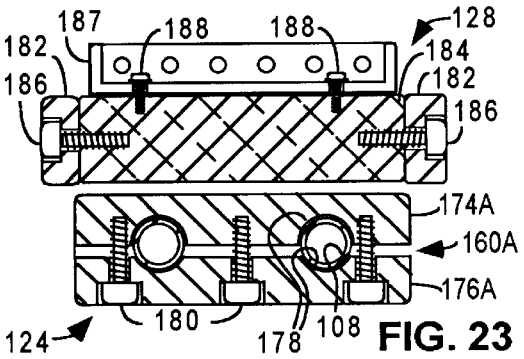
FIGS. 23 and 24 are cross-sectional views of the bridge assembly component shown in FIGS. 1–3 and 8–10, taken, respectively, along the lines 23—23 and 24—24 in FIG. 9.
Figure 24:
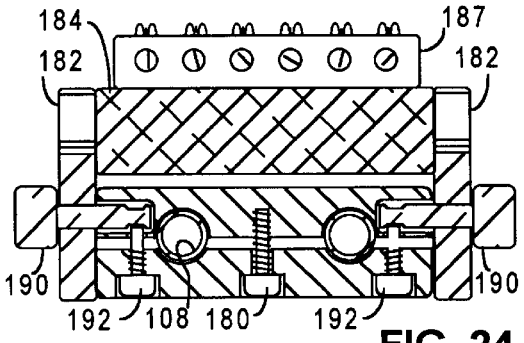
Figure 25:
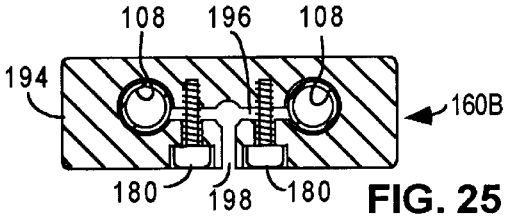
FIG. 25 is a cross section of an alternate embodiment of the component-to-frame clamps shown in FIGS. 22–23, taken along the same cross section as are those figures.

FIGS. 23 and 24 show two cross sections of the bridge component 124 taken, respectively, along the lines 23—23 and 24—24 in FIG. 9. As can be seen from FIGS. 9 and 10, the component-to-frame clamp 160A of the bridge assembly extends in the direction of the frame rods 108 substantially further than do the component-to-frame clamps 160 of the pick-ups, just discussed. Along most of its length along the rods 108, the clamp 160A, and its top and bottom blocks 174A and 176A, have the same cross section as the clamps 160, shown in FIG. 22. As is shown in FIG. 25, however, near the front of the clamp 160A, its cross section differs to support the ability of the bridge module 128, which is shown separated from the clamp 160A in FIG. 11, to be quickly attached to, or removed from, the clamp.

The bridge module 128 is comprised of two metal side plates 182, which are screwed into a bridge-supporting block 184 with screws 186. The bridge-supporting block 184 can be seen in FIGS. 8, 10, 23, and 24. A bridge 187, for terminating the vibration of, and holding one end of, each of a set of six musical strings, is screwed onto the bridge-supporting block with screws 188, shown in FIG. 23.

It is preferred that multiple bridge-supporting blocks be made, with different blocks having different vibrational characteristics. For example, a metallic bridge-supporting block will not filter out high frequency vibration much, tending to giving a guitar using it a sharper sound, whereas a wooden bridge-supporting block will tend to filter out such vibration more, creating a more mellow sound. Some bridge-supporting blocks can have made to have resonances at certain frequency ranges within the vibrations produced by the guitar's strings. This enables such bridge-supporting blocks to boost the volume of vibrations within such resonant frequency ranges. For example, some bridge-supporting block could be hollow to give them such a resonance.

The provision of such different bridge-supporting blocks allows a user to vary the sound of a guitar by screwing a different bridge-supporting block between the side plates 182, shown in FIG. 23, and then screwing the bridge into that different block.

The two side plates 182 of the bridge module are connected to the clamp 160A by two removable pins 190, which can be held in place by tightening two respective screws 192, which will then engage a groove around the circumference of the end of their associated pin. By untightening the screws 192, the pins 190 can be pulled out and another bridge module, such as the bridge module 128A shown in FIG. 11 can be attached.

FIG. 25 illustrates an alternate embodiment of a component-to-frame clamp 160B which can be used in place of the clamps 160 and 160A shown in FIGS. 22 and 23, respectively. This clamp has only one aluminum block, block 194, rather than a top and bottom block as does the clamp 160. The block 194 has two cylindrical holes bored in it sized to fit around the frame rods 108. It also has a gap 196 cut between its two cylindrical holes, and a gap 198 which splits the portion of the block between the gap 196 and the bottom of the block, into two under-hanging portions. A screw 180 can be used to tighten each of these under-hanging portions to the upper part of the block, so as to tightly hold one of the rods 108.

This clamp has the advantage of being more solid, having fewer parts, and requiring fewer screws to tighten or loosen the clamp, but it has the disadvantage of requiring that the clamp be slid all the way to the end of the frame to remove it from the frame. This requirement means that such a clamp cannot be removed from the frame without first removing all other clamps between it and the end of the frame.

Figure 26:
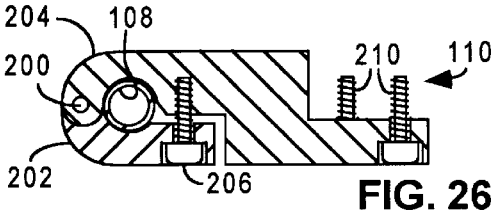
FIG. 26 is a cross-sectional view of one of the clamps used to attach each body component to the frame of the guitar shown in FIG. 1, taken along the line 26—26 shown in FIG. 10.
Figure 27:
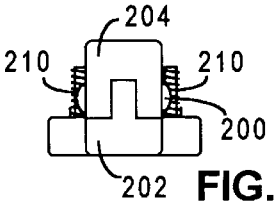
FIG. 27 is a frontal view of the clamp shown in FIG. 26.

FIGS. 26 and 27 illustrate the clamp 110 which is one of the clamps used to connect body-part components to one rod of the frame. The Clamp 110 has a hinge 200 which connects clamping jaw 202 to the main, upper portion 204 of the clamp. A screw 206 can be used to tightened the clamping jaw around the frame rod 108 to which the clamp is attached. If the screw is totally unscrewed, the jaw can be dropped far enough to allow the clamp to be totally removed from the rod 108. Screws 210 are used to screw the clamp into the remainder of the body-part component, which is normally made of a material such as wood, metal, or plastic.

Figure 28:
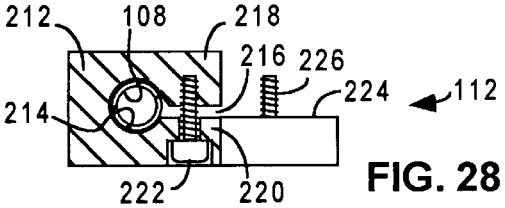
FIG. 28 is a cross-sectional view of another clamp used to attach each body component to the frame, taken along the lines 28—28 in FIG. 10.

FIG. 28 illustrates a cross section of the clamp 112 used to connect the bottom of each of the body parts 104 and 106 shown in FIGS. 1–3 to an associated frame rod. This cross section is taken along the lines 28—28 in FIG. 10. The clamp is made of a block of metal which has a thicker end portion 212. This thicker end portion is also shown in FIG. 10. A cylindrical hole 214 has been bored into the end portion so as to allow it to fit around one frame rod 108. This end portion has a gap 216 cut from one side to the hole 214, so the end portion is split into a separate upper and lower parts 218 and 220, respectively, on one side of the hole. A screw 220 allows these two part to be tightened so as to clamp around the rod 108 with varying degrees of tightness. The clamp includes a larger flat portion 224, also shown in FIG. 10, which includes screws 226 for attachment to the rest of the body-part component.

Although not shown in detail, the clamps 138, shown in FIG. 10, which hold and/or rotatably mount the control box onto one rod of the frame, have a hinging clamping jaw at their end similar to that of the clamp 110 shown in FIG. 26.

Now that the components of the guitar 100 have been explained, one can see by viewing FIGS. 1–3 and 8–10 the relative positions at which these components can be mounted on the frame 102 to form the complete guitar 100.

FIGS. 29–42 disclose some of the many other types of frames which can be used with the present invention.

Figure 29:
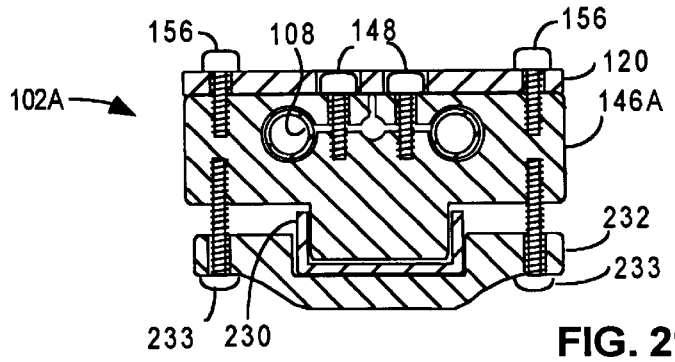
FIG. 29 is a cross-sectional view, taken along the lines 29—29 shown in FIG. 30, of a frame equivalent to that shown in FIGS. 12–21, except that it has a torsion bar and additional clamps to provide extra stiffness.
Figure 30:
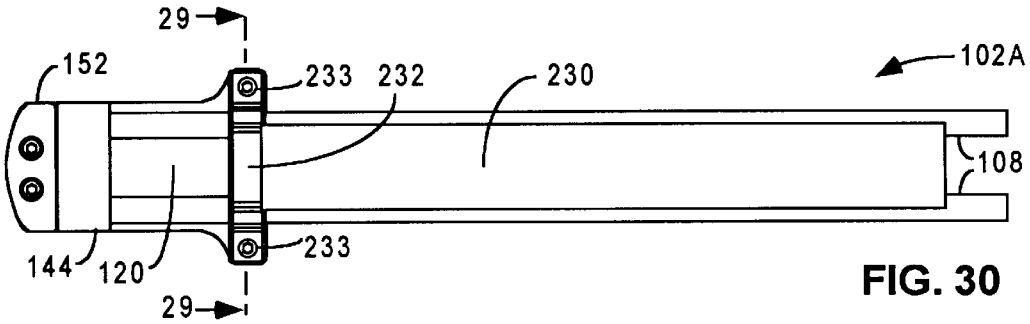
FIGS. 30 and 31 are top and bottom views of the frame shown in cross section in FIG. 29.
Figure 31:
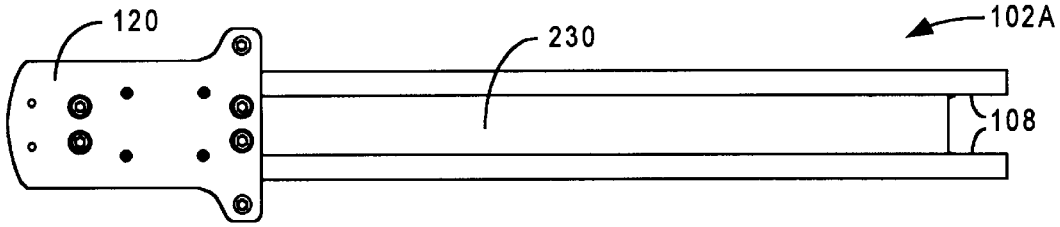
Figure 32:
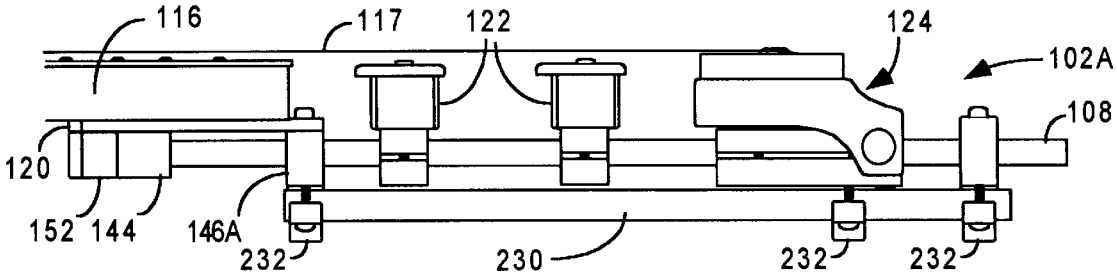
FIG. 32 shows how modular components similar to those shown in FIG. 9 can be attached to the frame shown in FIGS. 29–31.

FIGS. 29–32 disclose a frame 102A which is similar to the frame 102 described above, except that it has a U-beam torsion bar 230, placed below its two rods 108. It also has clamps 232 and screws 233 for holding the torsion bar in place, and some of its clamping blocks, such as the front frame clamp 146A shown in FIG. 29, are designed to fill and clamp against the upper surface of the U-beam torsion bar.

The torsion bar is provided to stiffen the frame. Whether or not such stiffening is needed is a function of the stiffness of the rods 108; the length of the frame's rods which is stiffened by large clamping blocks, such as the blocks of the bridge assembly clamp 160A described above; and the amount of stiffness individual player desires. In other embodiments, the torsion bar can be extended all the way to the back of the frame.

FIGS. 33, 35, 37, 39, and 41 are cross sections of some of the many other types of frames which can be used with the present invention, and FIGS. 34, 36, 38, 40, and 42, respectively, illustrate component-to-frame clamps which can be used with such frames.

Figure 33:
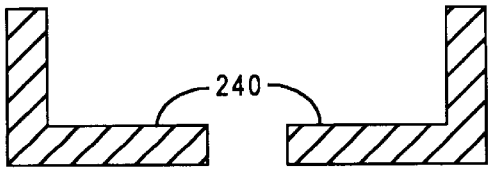
FIGS. 33, 35, 37, 39, and 41 show cross sections of other types of frames which can be used in alternate embodiments of the invention.
Figure 34:
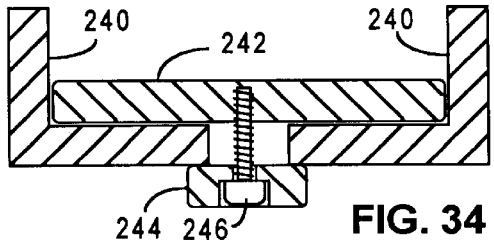
FIGS. 34, 36, 38, 40, and 42 show cross sections of clamps which can be used to clamp components to the frames shown in FIGS. 33, 35, 37, 39, and 41, respectively.

The frame in FIGS. 33 and 34 is composed of two L-shaped elongated structures 240. The component-to-frame clamp used with such a frame is composed of a top plate 242, shown in FIG. 34, fitting between the upward extending walls of such a frame, into which components could be screwed. This clamp also includes a bottom plate 244, below the structures 240, which could be tightened toward the top plate with a screw 246. The structures 240 could be made hollow or could be made thinner to reduce weight.

Figure 35:
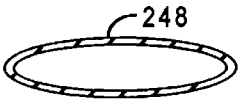
Figure 36:
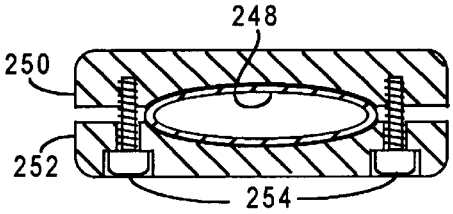

The frame in FIGS. 35 and 36 is comprised of an elongated hollow oval structure 248. Its corresponding component-to-frame clamp is comprised of a top block 250 and a bottom block 252, each with a shallow groove designed to fit against the curvature of the structure 248, and with screws 254 to tighten the two blocks together.

Figure 37:
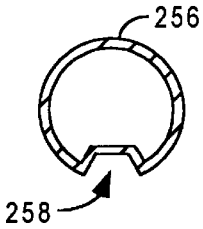
Figure 38:
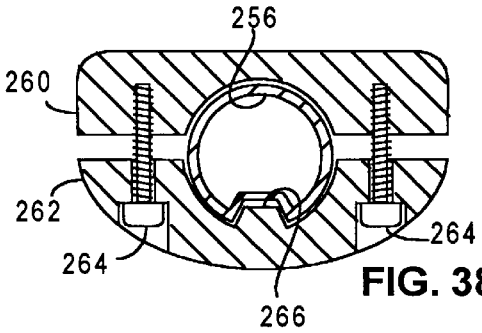

The frame in FIGS. 37 and 38 is comprised of a single cylindrical rod 256 which includes a groove 258. As is shown in FIG. 38, the component-to-frame clamp is comprised of top and bottom blocks 260 and 262, which can be tightened around the rod 256 by screws 264. The bottom block 264 includes a spline 266 for engaging the groove 258, so as to prevent the clamp from rotating relative to the rod 256. The clamps for body-part components or the control box will not have such a spline if it is desired to rotatably mount such components on the frame.

Figure 39:
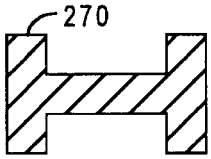
Figure 40:
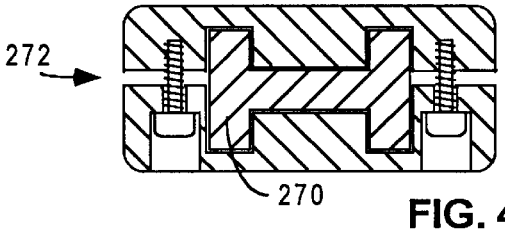
Figure 41:
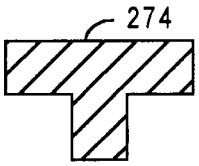
Figure 42:
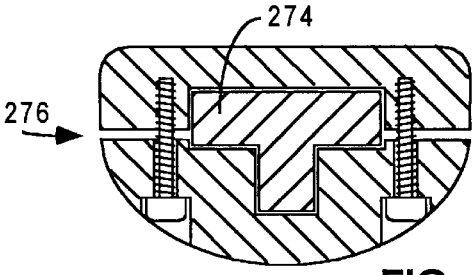

FIGS. 39 and 40 show an I-beam shaped frame 270 and corresponding clamp 272, respectively, and FIGS. 41 and 42 show a T-shaped frame 274 and corresponding clamp 276, respectively.

It should be appreciated that many other types of elongated frames could be used with the present invention, and that such frames could be made out of many different types of material, including stainless steel, titanium, ceramic materials, composite materials, plastics, or a combination of different materials. In some embodiments, the frame could be molded so that the portion of the frame which is designed to be mounted to the neck could be formed as part of a single-piece construction with the elongated structure onto which components such as pick-ups, bridges, and body parts are clamped.

Figure 43:
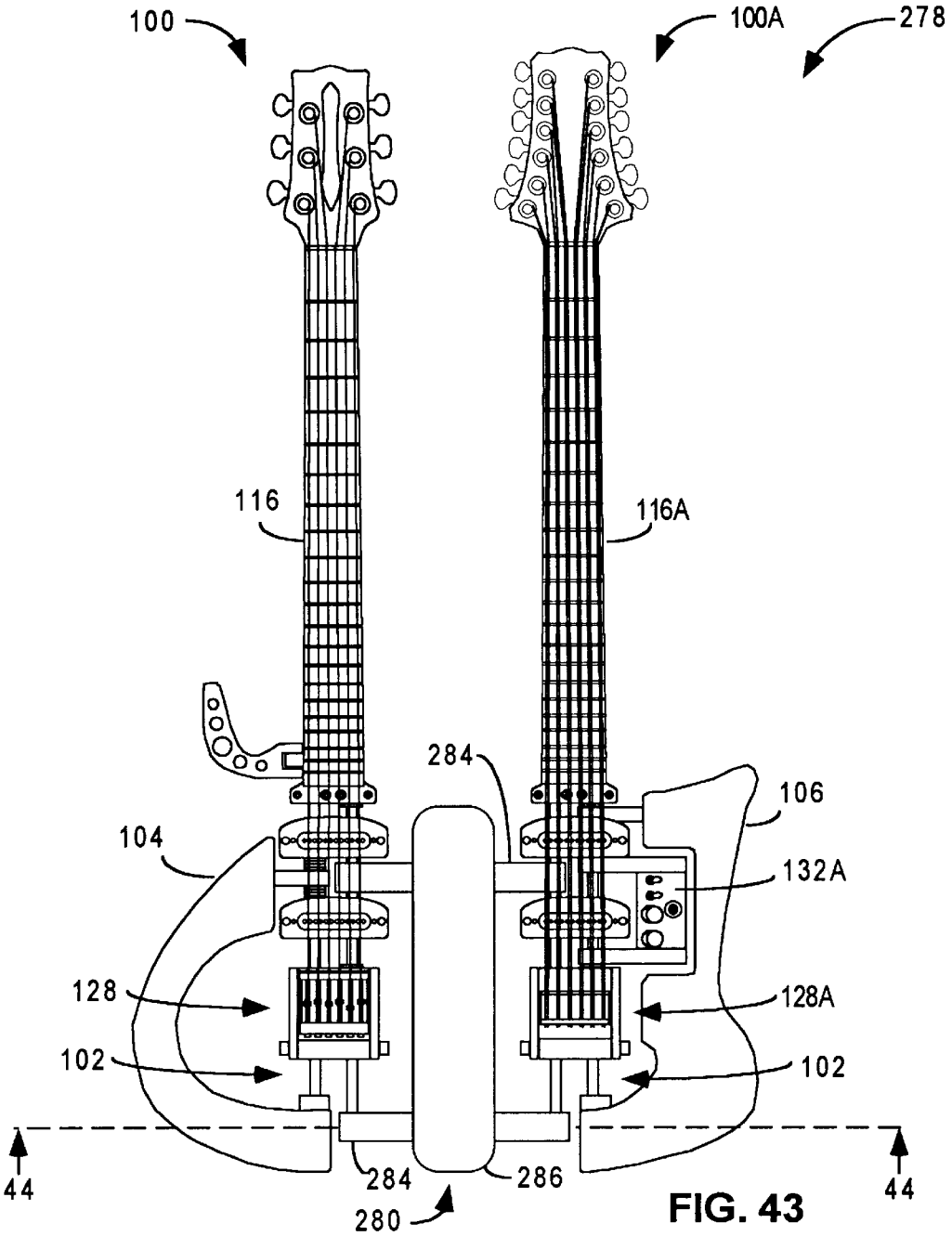
FIG. 43 shows how a clamp can be used to connect what are substantially two modular guitars of the general type shown in FIG. 1 to make a double-neck guitar.
Figure 44:
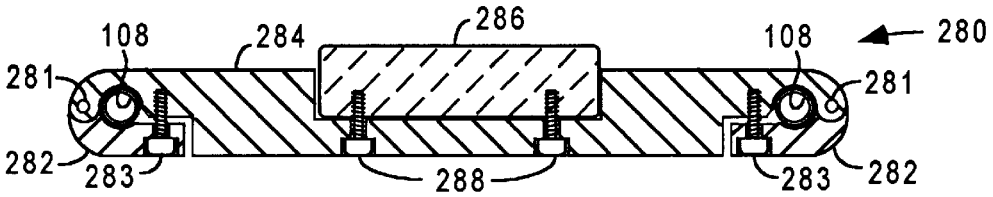
FIG. 44 is a cross section taken along the line 44—44 shown in FIG. 43 of the clamp used to connect the two portions of the double-neck guitar shown in FIG. 43.

FIG. 43 shows a double-neck guitar 278 which can be formed by clamping together two guitars 100 and 100A constructed from components shown in FIG. 11, using the clamp 280 shown in cross section in FIG. 44. In this double-neck guitar 278, the six-string guitar 100 is the same as the guitar 100 shown in FIGS. 1–10, except that the lower body part 106 and the control box 132 shown in those figures have been removed. The twelve-string guitar 100A is the same as the guitar 100 shown in FIGS. 1–10 except that 1) it uses the twelve-string neck and bridge module 116A and 128A, respectively, instead of the six-string neck and bridge module, 116 and 128; 2) it is missing the upper body part 104; and 3) its control box 132A has been modified to receive inputs from two different sets of pick-ups.

The two guitars 100 and 110A are clamped together into one double-neck guitar 278 with the clamp 280 shown in FIGS. 43 and 44. The clamp 280 has two clamping arms 284 connected together by a middle body part 286, which are attached to the arms via screws 288. Each of the arm has clamping jaws 282 at each of its two ends which are connected to the arm at a hinge 281, and which can be tightened around a frame rod 108 which a screw 283.

In other embodiments, each end of one or more of the clamps 280s' arms could be designed to clamp around both rods of the frame 102 so as to prevent each of the guitars 100 and 100A from rotating relative to the clamp between them.

FIG. 45–48 show how a lift-off head can be used with the present invention to make it even easier to change the strings used with a guitar or other musical instrument, such as to change from six to twelve strings, or from metal to non-metallic strings.

Figure 45:
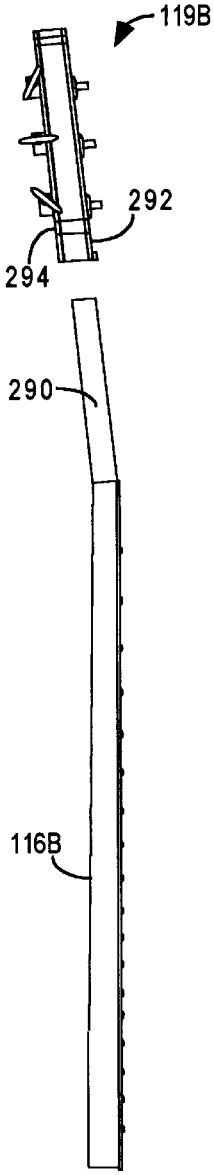
FIGS. 45 and 46 are side views of a guitar neck with a lift-off head assemble, which assembly is shown off in FIG. 45 and shown on in FIG. 46.
Figure 46:
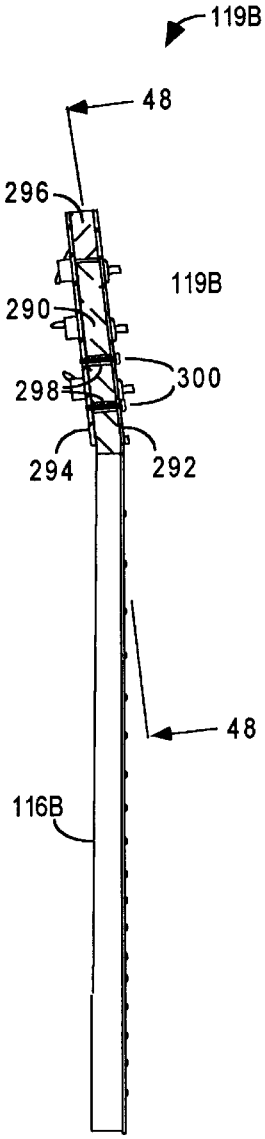
Figure 47:
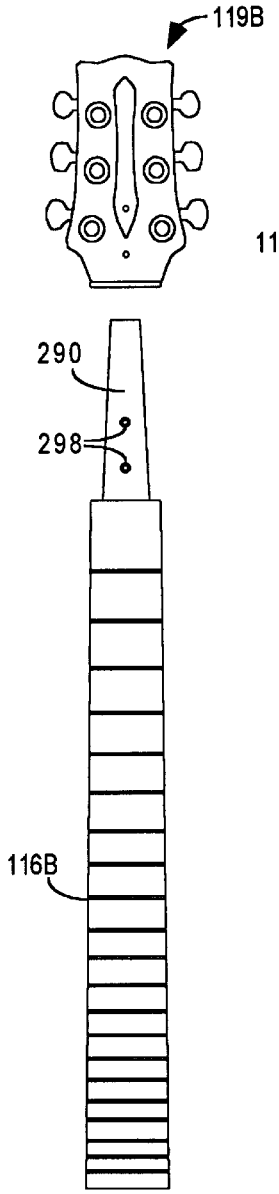
FIGS. 47 and 48 are front views, corresponding to the views on FIGS. 45 and 46, respectively.
Figure 48:
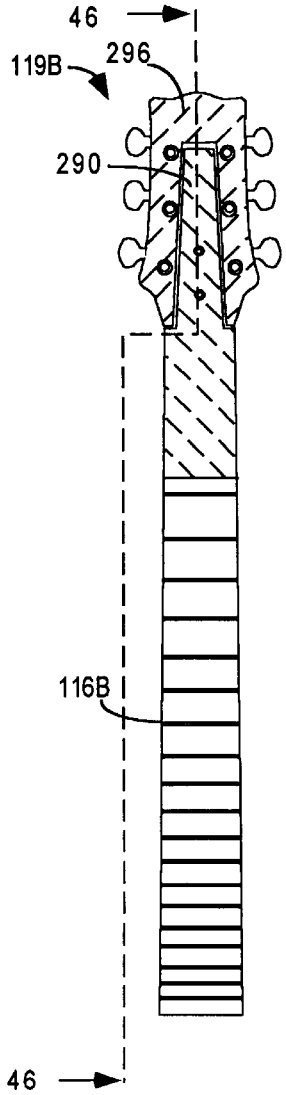

FIG. 45 is a side view of a lift-off head 119B and a neck 116B designed for use with it. FIG. 46 is a cross-sectional view of the neck and head once assembled, with the cross section taken along the lines 46—46 shown in FIG. 48. FIG. 47 is a front view of the neck and the head separated. FIG. 48 is a front, partially cross-sectional view of the neck and head joined, with the cross-sectional portion of the view being taken along the lines 48—48 shown in FIG. 46. As can be best seen in FIGS. 47 and 48, the neck 116B includes an extension 290 around which the lift-off head 119B is designed to be fitted.

The lift-off head includes top and bottom plates, 292 and 294, shown in FIGS. 45 and 46, which are intended to tightly sandwich the extension 290, shown in FIGS. 45–48, over which the lift-off head can be attached to the neck. The head also includes spacing material 296, normally wood, which is just a little thicker than the extension 290 located between its two plates. The extension 290 includes two holes 298, shown in FIGS. 47–48, through which two screws 300, shown in FIG. 46, can be placed when the head is placed over it to lock the head firmly in place. When these screws are removed, the head can be lifted off.

Figures 49, 50, 51, 52, 53:
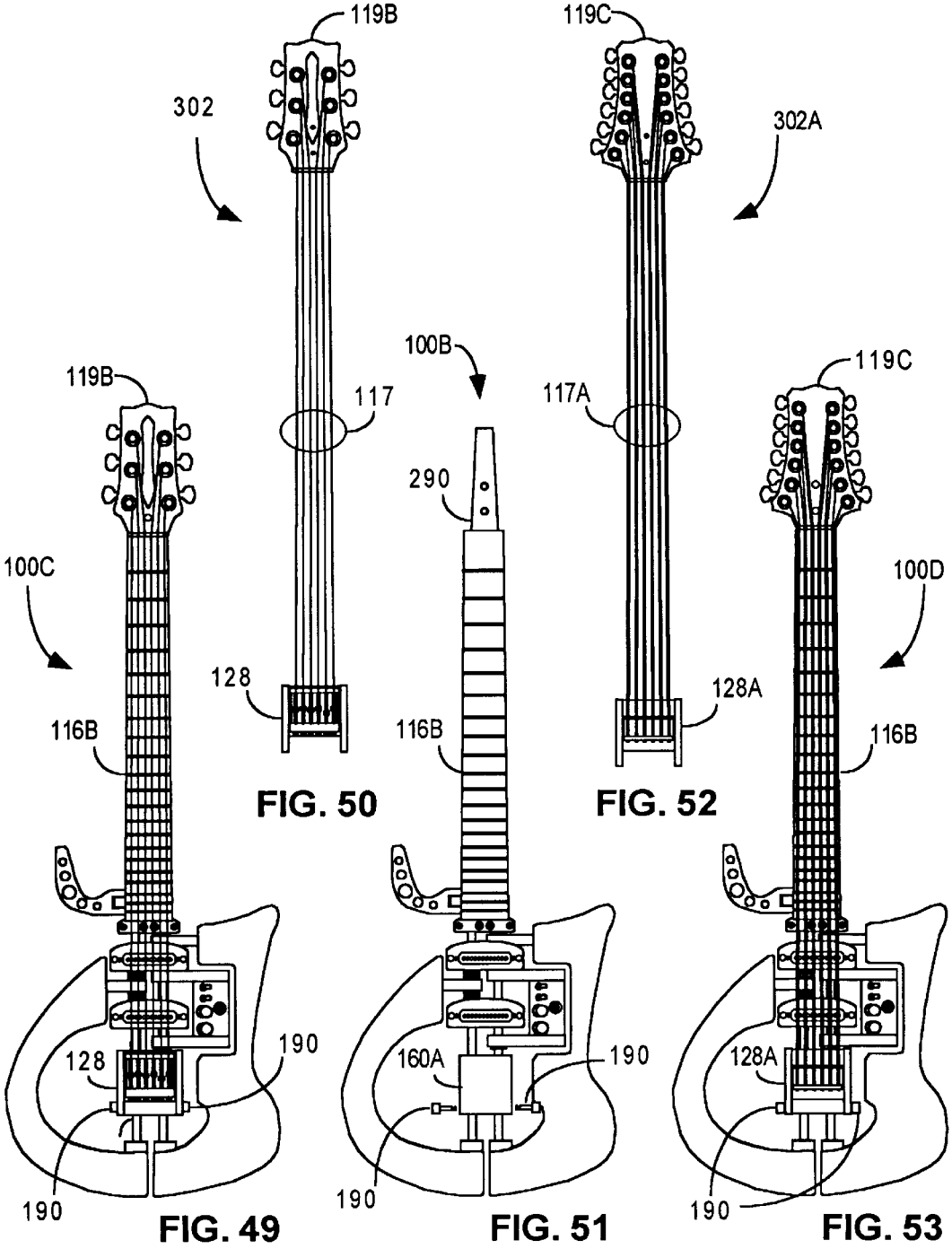
FIGS. 49–53 are front views of a single guitar with two lift-off string assemblies, with FIG. 51 showing the guitar without any such assemblies; with FIG. 50 showing a six-string string assembly; with FIG. 49 showing the guitar of FIG. 51 with the six-string string assembly attached; with FIG. 52 showing a twelve-string string assembly; and with FIG. 53 showing the guitar of FIG. 51 with the twelve-string string assembly attached.

FIGS. 49–53 illustrate how the combination of this lift-off head and the changeable bridge modules discussed above allowed a guitar 100B shown in FIG. 51 to be changed into either a six-string guitar 100C shown in FIG. 49 or a twelve-string guitar 100D shown in FIG. 53.

The guitar of FIG. 51 is substantially identical to the Guitar 100 shown in FIGS. 1–10, except that 1) it has the neck 116B shown in FIGS. 45–48 without an associated lift-off head attached; and 2) its bridge assembly 128 has been removed from its bridge assembly clamp 160A by releasing the pins 190, discussed above with regard to FIG. 24.

FIG. 50 shows a six-string string assembly 302 including the six-string lift-off head 119B shown in FIGS. 45–48, the six-string bridge module 128 described above with regard to FIG. 11, and a set 117 of six musical strings. A user can attach this assembly to the guitar in FIG. 51 by sliding the head 119B of FIG. 50 onto the neck extension 290, screwing the head 119B on, and then attaching the bridge module 128 of FIG. 50 to the bridge assembly clamp 160A with the pins 190. Unless the strings 117 have been loosened substantially at the head 119B, loosening the bridge assembly clamp and sliding it toward the neck slightly will facilitate the mounting of the bridge module to that clamp. Once the bridge module is attached, the clamp can be slid in the opposite direction to its desired position and then tightly clamped into place. Once this is done the guitar 100B in FIG. 51 will be converted to the six-string guitar 100C of FIG. 49. At this time, once the guitar has been tuned, it should be ready for play.

Similarly the guitar of FIG. 51 can be converted into a twelve-string guitar by placing the twelve-string string assembly 302A of FIG. 52 upon it. This assembly includes a twelve-string head 119C which is designed to fit on the neck extension 290 shown in FIG. 51 in a manner similar to the six-string head of FIG. 50. The twelve-string string assembly also includes a twelve-string bridge module 128A and a set 117A of twelve strings. Once this is done the guitar of FIG. 51 will have been converted into the twelve-string guitar 100D shown in FIG. 53.

In the embodiments shown in FIGS. 49–53, the bridge module is designed to both function as a bridge, which terminates the vibration of strings, and a tail-piece, which holds the ends of string. In some embodiments of the invention, the string assembly will consist of a set of strings, and a head and a tail piece connected to opposite ends of those strings. In many embodiments shown in FIGS. 49–53 the "nut", i.e., the bar that terminates vibrations of the strings near the head, is part of lift-off head. In other embodiments of the invention the lift-off portion of the head might not include the nut, and the nut would be part of the neck. In other embodiments of the invention, it is also possible that the lift-off string assembly would include an elongated structure, such as a metal bar between the head and tail piece which would keep the strings taught when the string assembly is removed from the guitar. String assemblies, such as the string assemblies 302 and 302A, will be made much more easier to use and transport if a case is provided to hold and carry one or more of them in a manner which prevents their strings from getting tangled.

The guitars shown in FIGS. 49–53 would also make it much easier to convert a given guitar from being a right-handed guitar to a left-handed one. This could be done by replacing a right-handed string assembly with a left-handed string assembly, clamping the control box and strap attachment, to the other frame rod 108, and attaching one or more new body parts, designed for left-handed guitars, to each of the guitar's two frame rods. In fact, body parts could be manufactured which could be used just as well on the left or right side of the guitar, requiring only that the string assembly be replaced, and the sides of the frame to which the control box, strap attachment, and body parts are connected be changed.

Figure 54:
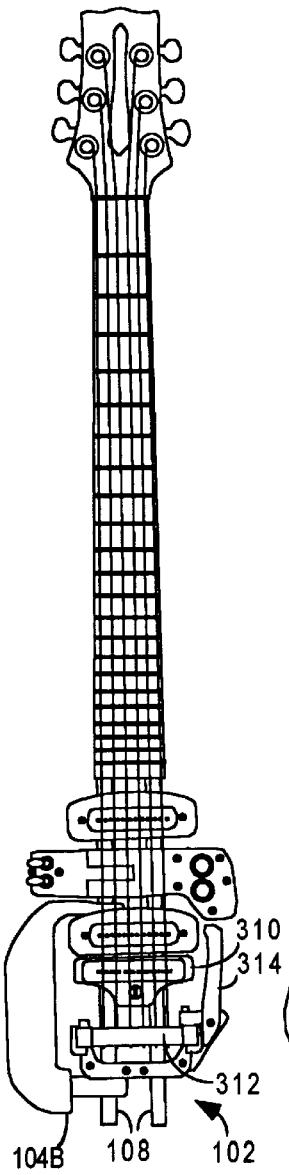
FIGS. 54–56 show a modular guitar similar to that of FIGS. 1–10 with alternate components attached.
Figure 55:
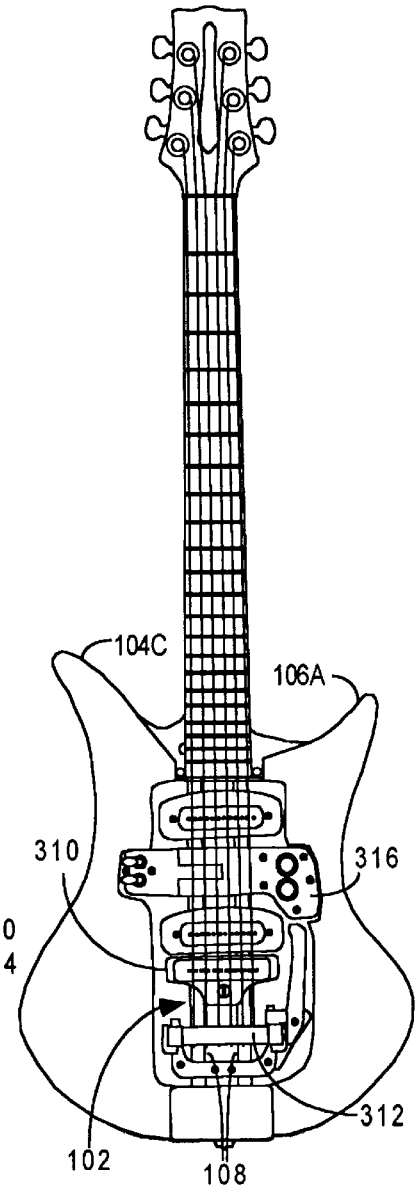
Figure 56:
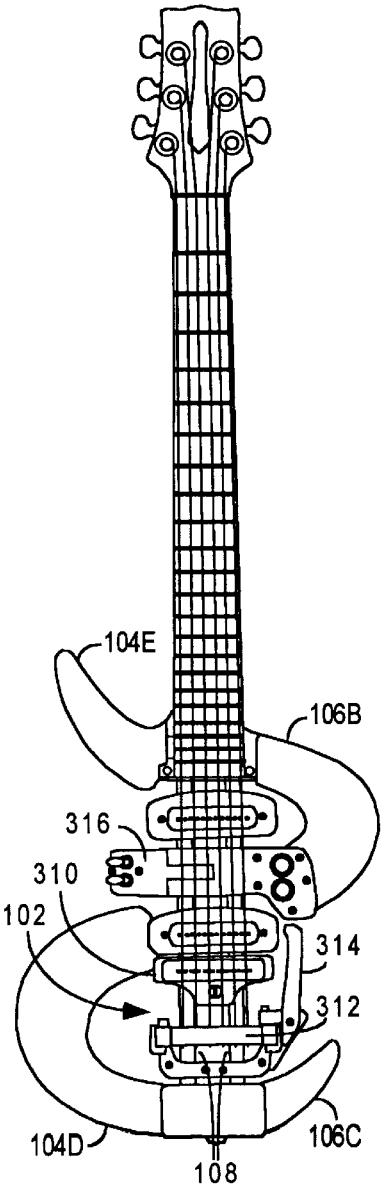

FIGS. 54–56 illustrate three other guitars which can be created according to the present invention using a frame, such as the frame 102. All of these guitars have separate bridge and tail piece components, 310 and 312, respectively. Each of these components is clamped to the frame's two rods 108 by means of component-to-frame clamps of the general type discussed above. The bridge terminates the vibration of the strings and the tail piece holds the ends of those strings. The tailpiece shown in these figures has a lever 314, shown in FIGS. 54 and 56, which can be used to vary the tension on the musical strings, and thus vary the pitch produced by such strings so as to produce a vibrato effect.

The guitar of FIG. 54 includes a small metal hand rest 104B as its upper body part for supporting a player's strumming hand. This metal hand rest is rotatably clamped around one of the guitar's two frame rods 108. The guitar of FIG. 54 includes no lower body part to support the guitar against a player's body. As a result it has a very strange, high-tech look.

The guitar of FIG. 55 is identical to that of FIG. 54, except that the hand rest 104B has been removed and, instead, it has both upper- and lower- body-part components 104C and 106A. This gives the guitar a slightly more traditional appearance. These body parts are mounted to both ends of the frame and to both ends of a centrally mounted control box component 316. They are not designed to rotate relative to the frame.

The guitar of FIG. 56 is similar to the guitar of FIG. 55, except that its body-part components have been changed. It has two upper body parts, one, 104D, which functions as a rest for the strumming arm or hand, and one, 104E, to which a strap can be attached. It also has two lower-body parts 106B and 106C. Together all of the body parts provide the guitar an exotic shape suggestive of a snake. These body parts are mounted to the frame and to the control box 316. They are not rotatable.

FIGS. 57–62 illustrate an embodiment of the invention which has rotatable body parts, but which does not have modular component mounted on an elongated frame, as do all of the guitars shown in the previous figures.

Figure 57:
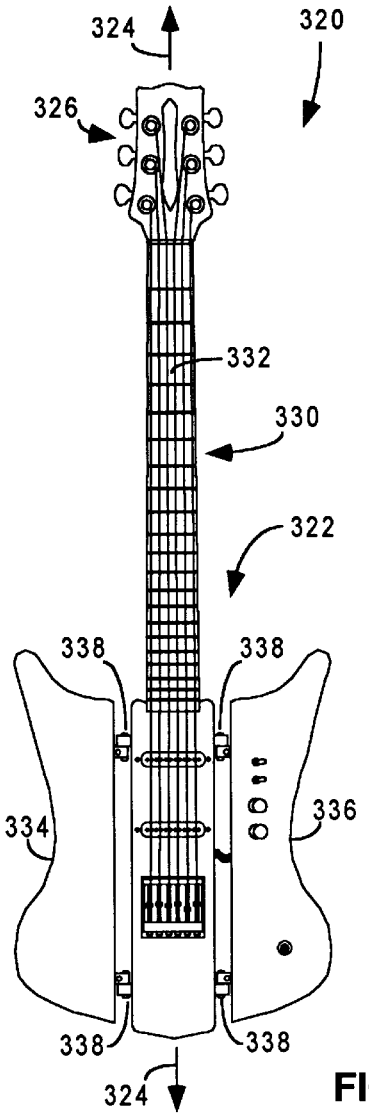
FIG. 57 is a top view of a another embodiment of the invention, a guitar which does not use the modular frame-and-component construction of the embodiment in FIG. 1, but which instead has a unitary string-mounting structure, including a neck and a bridge, and two body parts each of which are rotatably mounted relative to the string-mounting structure.
Figure 58:
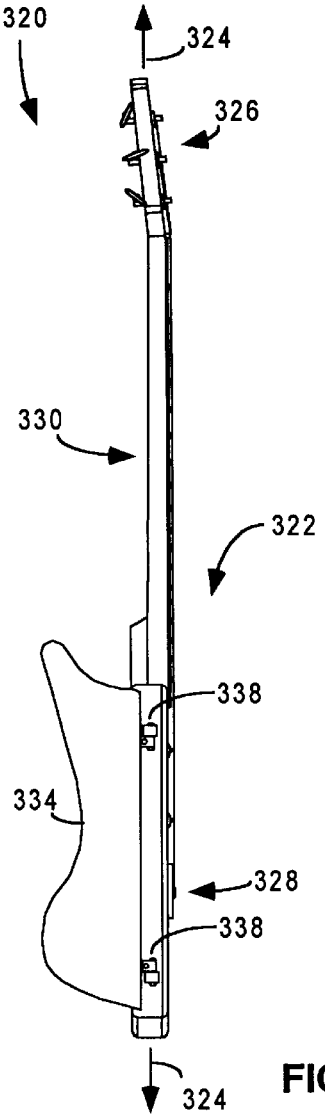
FIG. 58, is a side view of the guitar of FIG. 57 with its two body parts rotated ninety degrees below the plane of the drawing in FIG. 57.
Figure 59:
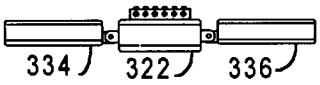
FIGS. 59–62 are bottom-end views of the guitar of FIG. 57 showing different rotational angles between the guitar's central string-mounting structure and its two body parts.
Figure 60:
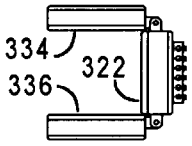
Figure 61:
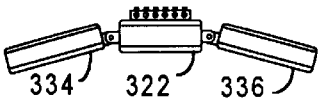
Figure 62:
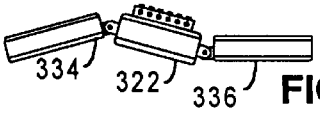

FIGS. 57 and 58 provide top and side views of the guitar 320. This guitar includes a string-mounting structure 322 extending along a longitudinal axis 324, defined by the arrows 324, between top and bottom ends, respectively. At its top end the string-mounting structure includes a structure in the form of a head 326 for terminating the vibration of, and holding one end of each of a set of lengths of musical string. At its bottom end, the string-mounting structure includes a bridge for terminating the vibration of, and holding, a second end of each of, the set of lengths of musical string. In other embodiments the bottom end could be comprised of both a bridge and a tail piece. The string supporting structure has a neck 330 extending from its top end toward its bottom end. The neck includes a fingerboard 332 which lies within a plane substantially parallel to the longitudinal axis 324.

In addition to the string-mounting structure, the instrument further includes upper and lower body structures 334 and 336, each including rotatable mountings 338 which mount the body structures to the string-mounting structure so the body structure can be rotated about an axis substantially parallel to the longitudinal axis of the string-mounting structure. The upper body structure 334 often functions to provide a rest for the strumming hand of the person playing the guitar. The lower body structure 336 often functions to support the guitar from the player's body, and particularly from the player's legs when the player is sitting.

FIGS. 59–62 are bottom-end views of the guitar of FIGS. 57 and 58, illustrating, in a manner similar to FIGS. 4–7, how the body of that guitar can be rotated relative to its string-mounting structure.

It should be understood that the foregoing description and drawings are given merely to explain and illustrate the invention and that the invention is not limited thereto, except insofar as the interpretation of the appended claims is so limited. Those skilled in the art who have the disclosure before them will be able to make modifications and variations therein without departing from the scope of the invention.

For example, as stated above, the invention is applicable to other types of stringed instruments beside guitars, including without limitation mandolins, bass guitars, banjos, bass fiddles, cellos, and violins. In fact, by altering the neck and certain other components one could build either a guitar, a mandolin, or a bass guitar by using the same frame. However, because each of these instruments has a different length, it is possible that one might want to change the rods used with a given frame to better accommodate such different length.

It should also be understood, as stated above, that in other embodiments of the invention the elongated frame upon which modular components are mounted could be very different from the two rods 108 discussed above. Only a subset of such other types of frames is discussed above in FIGS. 29–42. Similarly the number of different types of components which can be mounted on such frames could vary tremendously. Also many different types of clamps could be used to attach such components to frames besides the relatively simple clamps described above.

In the embodiments above, the neck and frame are joined by screws. In other embodiments other types of mountings could be used. For example, in some embodiments mounting schemes could be used that would let the neck and frame be locked together merely by forcing them together, and released merely by pushing a locking restraint out of the way. Also in other embodiments other schemes besides the combinations of screws and a shim shown in FIG. 21 can be used to alter the angle between the neck and frame. In some embodiments the neck and frame could be permanently joined, although such permanent joinder would not allow necks to be changed.

It should be understood that in alternate embodiments of the invention some body parts might be rotatably mounted, and others on the same guitar might not be. Similarly there might be multiple separately rotatable body parts located on one or more sides of the guitar.

It should also be understood that the materials used with the invention could be varied. The rods 108 are made of hollow stainless steel tubes in a preferred embodiment of the invention, but they could be made solid to provide extra rigidity at the expense of added weight. The inventor has found that stainless steel rods work quite well with clamps made of aluminum, which is softer than stainless steel, but other materials could be used for both the clamps and the rods. In other embodiments the frame rods could be made out of solid lightweight material using an alloy of aluminum, titanium, and/or vanadium.

What I claim is:

1. A stringed instrument comprising:

a head for holding and terminating the vibration of one end of a length of each of a set of musical strings;

a neck which extends along a longitudinal axis between the neck's top and bottom ends, which is connected to the head near the neck's top end, and which includes a fingerboard extending between the head and the neck's bottom end;

an elongated frame which extends along a longitudinal axis, said frame including a frame-to-neck mounting for attachment to the neck so the frame extends out from the bottom end of the neck and so the longitudinal axis of the neck and of the frame are roughly parallel; and at least two adjustably positionable components each including a component-to-frame mounting for adjustably fixedly attaching to the frame at any one of a number of positions along the frame's longitudinal axis;

wherein:

one of said adjustably positionable components is a bridge component having a bridge for terminating the vibration of the other end of each of said lengths of string; and one of said adjustably positionable components is a pick-up component including electronic circuitry for deriving an electronic signal from the vibrations of said strings.

2. A stringed instrument as in claim 1 wherein one of said adjustably positionable components is a body part.

3. A stringed instrument as in claim 2 wherein said body part's component-to-frame mounting is a rotatable mounting which allows the body part to rotate about an axis generally parallel to the longitudinal axis of the frame.

4. A stringed instrument comprising:

a head for holding and terminating the vibration of one end of a length of each of a set of musical strings;

a neck which extends along a longitudinal axis between the neck's top and bottom ends, which is connected to the head near the neck's top end, and which includes a fingerboard extending between the head and the neck's bottom end;

an elongated frame which extends along a longitudinal axis, said frame including a frame-to-neck mounting for attachment to the neck so the frame extends out from the bottom end of the neck and so the longitudinal axis of the neck and of the frame are roughly parallel; and at least two adjustably positionable components each including a component-to-frame mounting for adjustably fixedly attaching to the frame at any one of a number of positions along the frame's longitudinal axis;

wherein:

one of said adjustably positionable components is a bridge component having a bridge for terminating the vibration of the other end of each of said lengths of string;

one of said adjustably positionable components is a pick-up component including electronic circuitry for deriving an electronic signal from the vibrations of said strings;

the elongated frame includes two cylindrical rods each extending in a direction parallel to the frame's longitudinal axis; and the component-to-frame mounting of said adjustably positionable components include a clamp, which can be loosened to allow the component to slide along the rods and which can be tightened to allow the component to be fixed to the rods at a desired position.

5. A stringed instrument as in claim 4 wherein one of said adjustably positionable components is a body part which includes a clamp which extends around only one of the frame's two rods, and which can be loosened to allow the body part to rotate about the axis of the rod to which it is clamped, and which can be tightened to fix it at a given rotational angle relative to the frame.

6. A stringed instrument as in claim 4 wherein said frame further includes a torsion bar having a major axis which extends in a direction parallel to that of parallel rods.

7. A stringed instrument comprising:

a head for holding and terminating the vibration of one end of a length of each of a set of musical strings;

a neck which extends along a longitudinal axis between the neck's top and bottom ends, which is connected to the head near the neck's top end, and which includes a fingerboard extending between the head and the neck's bottom end;

an elongated frame which extends along a longitudinal axis, said frame including a frame-to-neck mounting for attachment to the neck so the frame extends out from the bottom end of the neck and so the longitudinal axis of the neck and of the frame are roughly parallel; and at least two adjustably positionable components each including a component-to-frame mounting for adjustably fixedly attaching to the frame at any one of a number of positions along the frame's longitudinal axis;

wherein:

one of said adjustably positionable components is a bridge component having a bridge for terminating the vibration of the other end of each of said lengths of string;

one of said adjustably positionable components is a pick-up component including electronic circuitry for deriving an electronic signal from the vibrations of said strings;

the component-to-frame mountings of said adjustably positionable components include clamps, which can be loosened to allow the component to slide along the longitudinal axis of the frame and can be tightened to allow the component to be fixed to the frame at a desired position.

8. A stringed instrument as in claim 1 wherein the bridge component includes:

said bridge for terminating vibration;

said component-to-frame mounting for fixedly attaching the bridge component to the frame; and a mounting structure for enabling a piece of a selected material to be selectively fixed and removed from between the bridge and the component-to-frame mounting, so as to allow the vibrational characteristics of the mounting between the bridge and the frame selectively changed.

9. A stringed instrument as in claim 1 wherein one of said adjustably positionable components includes an electronic control box, containing electronic controls which can be manipulated by one playing the guitar to alter the electronic signal generated by the pick-up's electronic circuitry.

10. A stringed instrument as in claim 1 wherein one of said adjustably positionable components includes decorative components which, in addition to possibly stiffening the frame or changing the balance of the instrument, serve no musical purpose, and are used mainly to change the appearance of the instrument.

11. A stringed instrument as in claim 1 further including a clamping structure which can be attached to said frame to fixedly attach said instrument to another similar stringed instrument by clamping to the frame of said other similar instrument.

12. A stringed instrument as in claim 1 wherein said instrument is a guitar.

13. A stringed instrument comprising:

a head near the neck's top end for holding and terminating the vibration one end of a length of each of a set of musical strings;

a neck which extends along a longitudinal axis between the neck's top and bottom ends, which is connected to the head near the neck's top end, and which includes:

a fingerboard extending between the head and the neck's bottom end; and a neck-to-frame mounting located near the neck's bottom end;

an elongated frame which extends along a longitudinal axis, said frame including a frame-to-neck mounting for attachment to the neck's neck-to-frame mounting so that the frame extends out from the bottom end of the neck and so the longitudinal axis of the neck and of the frame are roughly parallel; and one or more adjustably positionable components each including a component-to-frame mounting for fixedly attaching to the frame at any one of a number of positions along the frame's longitudinal axis;

wherein:

one of said adjustably positionable component is a bridge component having a bridge for terminating the vibration of the other end of each of said lengths of string; and the frame-to-neck mounting is designed to fit with the neck-to-frame mounting of any one of a number of necks which have the similar neck-to-frame mountings.

14. A stringed instrument as in claim 13 wherein one of said adjustably positionable components is a body part.

15. A stringed instrument as in claim 13 wherein one of said adjustably positionable components is a pick-up component including electronic circuitry for deriving an electronic signal from the vibrations of said strings.

16. A stringed instrument as in claim 13 wherein said neck-to-frame and frame-to-neck mountings include, between them, a device for enabling the angle between the neck and the frame to be varied.

17. A stringed instrument as in claim 16 wherein the device for enabling the angle between the neck and the frame to be varied includes a screw which can be tightened and loosened to pull together, or push apart, respectively, by variable amounts portions of the neck-to-frame and frame-to-neck mountings.

18. A stringed instrument comprising:

a head for holding and terminating the vibration of one end of a length of each of a set of musical strings;

a neck which extends along a longitudinal axis between the neck's top and bottom ends, which is connected to the head near the neck's top end, and which includes:

a fingerboard extending between the head and the neck's bottom end;

an elongated frame which extends along a longitudinal axis and which includes:

two cylindrical rods each extending in a direction parallel to the frame's longitudinal axis; and a frame-to-neck mounting for attachment to the neck so the frame extends out from the bottom end of the neck and so the longitudinal axis of the neck and of the frame are roughly parallel; and one or more adjustably positionable components each including a component-to-frame mounting for adjustably fixedly attaching to the frame at any one of a number of positions along the frame's longitudinal axis, said component-to-frame mounting including a clamp, which can be loosened to allow the component to slide along the rods and which can be tightened to allow the component to be fixed to the rods at a desired position;

wherein:

one of said adjustably positionable components is a bridge component having a bridge for terminating the vibration of the other end of each of said lengths of string; and one of said adjustably positionable components is a pick-up component including electronic circuitry for deriving an electronic signal from the vibrations of said strings; and two of said adjustably positionable components are each a body part, each of which includes a clamp which extends around only one of the frame's two rods, and which can be loosened to allow the body part to rotate about the axis of the rod to which it is clamped, and which can be tightened to fix it at a given rotational angle relative to the frame.

19. A stringed instrument comprising:

an elongated string mounting structure having two ends, a top and a bottom end, and extending along a longitudinal axis between said top and bottom ends; said structure including:

a structure at the top end for terminating the vibration of, and holding one end of each of a set of lengths of musical string;

a structure at the bottom end for terminating the vibration of, and holding, a second end of each of said set of lengths of musical string, which structure includes a bridge for terminating the vibrations of said strings; and a neck extending from the top end toward said bottom end, said neck including a fingerboard which roughly lies within a plane substantially parallel to said longitudinal axis; and a body structure including a rotatable mounting which mounts the body structure to the string mounting structure so the body structure can be rotated about an axis substantially parallel to the longitudinal axis of the string mounting structure.

20. A stringed instrument as in claim 19 wherein the body structure is sized to, and the body structure and its mounting are positioned to, support the strumming arm of a person playing the stringed instrument.

21. A stringed instrument as in claim 19 wherein the body structure is sized to, and the body structure and its mounting are positioned to, support the stringed instrument against the body of a person playing the instrument, so rotating the body structure relative to the string mounting structure can vary the angle of the plane of the fingerboard relative to the body of a person against which the instrument is being supported.

22. A stringed instrument as in claim 19 wherein there are at least two body structures, each including a rotatable mounting which enables it to be separately rotated about an axis substantially parallel to the longitudinal axis of the string mounting structure, said two body structures being mounted so they can be rotated to extend out from said string supporting structure in opposite directions which are generally perpendicular to the longitudinal axis of the string supporting structure and which are generally parallel to the plane of the fingerboard.

23. A stringed instrument as in claim 19 wherein the instrument is a guitar.

24. A stringed instrument as in claim 19 wherein:

the instrument is an electric stringed instrument; and the instrument further includes:

electronic circuitry for deriving an electronic signal from the vibrations of said strings;

an electronic control box, containing electronic controls which can be manipulated by one playing the guitar to alter the electronic signal generated by said circuitry; and a rotatable mounting which mounts the control box to rotate about an axis generally parallel with the longitudinal axis of the string supporting structure separately from the rotation of the body structure.

25. A stringed instrument as in claim 19 further including structure for enabling a user of the guitar to selectively vary resistance to the rotation of the body structure, to enable the user to selectively substantially fix such rotation at a desired position.

26. A stringed instrument comprising:

an elongated structure having two ends, a top end and a bottom end, and extending along a longitudinal axis between said top and bottom ends, including a neck extending from the top end toward said bottom end, said neck including a fingerboard which roughly lies within a plane substantially parallel to said longitudinal axis;

a head at the top end for holding one end of each of a set of musical strings;

a tailpiece at the bottom end for holding a second end of each of said set of musical strings;

a head-release mounting at the top end of the elongated structure for enabling a user to selectively fix the head to, or release the head from, the top end of the elongated structure; and a tailpiece-release mounting at the bottom end of the elongated structure for enabling a user to selectively fix the tailpiece to, or release the tailpiece from, the bottom end of the elongated structure;

whereby the operation of the head- and tailpiece-release mountings enable a user to replace one combination of a head, tailpiece, and a set of strings held between them with another such combination by releasing the first such combination from the head- and tailpiece-release mountings and then fixing the second such combination to the head-and tailpiece-release mountings.

* * * * *